US006840530B2

(12) United States Patent
Busby, Jr. et al.

(10) Patent No.: US 6,840,530 B2
(45) Date of Patent: Jan. 11, 2005

(54) LOAD DISTRIBUTING SYSTEM FOR SNOWBOARDS

(75) Inventors: James Steele Busby, Jr., 2516 Vista Dr., Newport Beach, CA (US) 92660; Mark Patrick Nex, Costa Mesa, CA (US)

(73) Assignee: James Steele Busby, Jr., Newport Beach, CA (US)

( * ) Notice: Subject to any disclaimer, the term of this patent is extended or adjusted under 35 U.S.C. 154(b) by 0 days.

(21) Appl. No.: 09/862,208

(22) Filed: May 21, 2001

(65) Prior Publication Data

US 2001/0054808 A1 Dec. 27, 2001

Related U.S. Application Data

(63) Continuation of application No. 09/351,040, filed on Jul. 9, 1999, now Pat. No. 6,234,513, which is a continuation-in-part of application No. 08/792,247, filed on Jan. 31, 1997, now Pat. No. 5,954,356, and a continuation-in-part of application No. 09/221,106, filed on Dec. 23, 1998, now abandoned.

(51) Int. Cl.[7] ..... A63C 5/06
(52) U.S. Cl. ..... 280/607; 280/14.22
(58) Field of Search ..... 280/602, 607, 280/608, 609, 14.21, 14.22, 14.23, 14.24, 28, 618

(56) References Cited

U.S. PATENT DOCUMENTS

| | | | | | |
|---|---|---|---|---|---|
| 4,403,785 | A | * | 9/1983 | Hottel | 280/607 |
| 4,871,337 | A | | 10/1989 | Harris | 441/74 |
| 4,973,073 | A | | 11/1990 | Raines et al. | 280/624 |
| RE33,544 | E | * | 2/1991 | Dennis | 280/14.23 |
| 5,028,068 | A | * | 7/1991 | Donovan | 280/14.24 |
| 5,035,443 | A | | 7/1991 | Kincheloe | 280/618 |

FOREIGN PATENT DOCUMENTS

| | | | | |
|---|---|---|---|---|
| DE | 3242913 | * | 5/1984 | A63C/5/07 |
| FR | 2659246 | * | 9/1991 | A63C/5/03 |
| WO | WO 99/10053 | | 3/1990 | |
| WO | WO 97/12650 | | 4/1997 | |
| WO | WO 97/22391 | | 6/1997 | |
| WO | WO 97/27914 | | 8/1997 | |
| WO | WO 98/32502 | | 7/1998 | |
| WO | WO 98/33563 | | 8/1998 | |
| WO | WO98/33563 | | 8/1998 | |
| WO | WO 98/45001 | | 10/1998 | |
| WO | WO 98/46313 | | 10/1998 | |
| WO | 99/12616 | * | 3/1999 | A63C/5/03 |
| WO | WO 99/25433 | | 5/1999 | |
| WO | WO 99/29377 | | 6/1999 | |
| WO | WO 99/46016 | | 9/1999 | |

(List continued on next page.)

*Primary Examiner*—Frank Vanaman
(74) *Attorney, Agent, or Firm*—Orrick, Herrington & Sutcliffe LLP

(57) ABSTRACT

A snowboard that facilitates turn carving by distributing the load applied by the rider over a much greater portion of the edge of the board preferably comprises a spider mount drive system operably mounted on the board. The drive system includes a drive base that is operably coupled to a boot binding and is adapted to distribute a load applied by a rider to multiple locations along the edge of the snowboard. The drive base preferably includes a central cross member and first and second elongated leg members extending outwardly from its heel and toe locations and is preferably pivotally mounted to the board. The drive base may be formed integrally with the binding or, alternatively, be formed as a separate insertable member. Alternatively, the snowboard preferably comprises V-shaped, diamond shaped or T-shaped drive members mounted to the snowboard or formed integrally therewith to increase the stiffness of the snowboard in the area between the binding mounts and direct a turning load toward the central axis of the snowboard. Additional stiffener fingers may be included that extend outwardly toward the nose and tail ends of the board.

4 Claims, 23 Drawing Sheets

U.S. PATENT DOCUMENTS

| | | | | | |
|---|---|---|---|---|---|
| 5,085,455 | A | | 2/1992 | Bogner et al. | 280/618 |
| 5,090,722 | A | | 2/1992 | Ritchie et al. | 280/607 |
| 5,284,357 | A | * | 2/1994 | Tinkler | 280/602 |
| 5,299,823 | A | * | 4/1994 | Glaser | 280/607 |
| 5,354,088 | A | | 10/1994 | Vetter et al. | 280/618 |
| 5,417,443 | A | | 5/1995 | Blattner et al. | 280/14.2 |
| 5,462,304 | A | | 10/1995 | Nyman | 280/609 |
| 5,558,354 | A | * | 9/1996 | Lion | 280/618 |
| 5,573,264 | A | * | 11/1996 | Deville et al. | 280/602 |
| 5,647,605 | A | | 7/1997 | Arduin | 280/14.2 |
| 5,671,940 | A | | 9/1997 | Abondance | 280/602 |
| 5,713,594 | A | | 2/1998 | Jenni | 280/624 |
| 5,782,482 | A | | 7/1998 | Andrus et al. | 280/602 |
| 5,810,370 | A | | 9/1998 | Covert et al. | 280/14.2 |
| 5,813,689 | A | | 9/1998 | Mansure | 280/607 |
| 5,823,562 | A | | 10/1998 | Stubblefield | 280/609 |
| 5,863,050 | A | | 1/1999 | Meader et al. | 280/14.2 |
| 5,895,068 | A | | 4/1999 | Doyle | 280/618 |
| 5,906,388 | A | | 5/1999 | Neiley | 280/613 |
| 5,930,835 | A | | 8/1999 | Silvestri | 2/16 |
| 5,954,356 | A | | 9/1999 | Busby, Jr. et al. | 280/602 |
| 5,971,419 | A | | 10/1999 | Knapschafer | 280/607 |
| 5,971,420 | A | | 10/1999 | Okajima et al. | 280/613 |
| 5,984,343 | A | * | 11/1999 | Longoni et al. | 280/602 |
| 6,053,522 | A | * | 4/2000 | Fogarty et al. | 280/607 |
| 6,059,306 | A | * | 5/2000 | Metrot et al. | 280/602 |

* cited by examiner

LOAD DISTRIBUTING SYSTEM FOR SNOWBOARDS

CROSS REFERENCE TO RELATED APPLICATIONS

This application is a continuation of U.S. application Ser. No. 09/351,040 filed on Jul. 9, 1999, now U.S. Pat. No. 6,234,513, which is a continuation-in-part of U.S. application Ser. No. 08/792,247, filed on Jan. 31, 1997, now U.S. Pat. No. 5,954,356, and a continuation-in-part of U.S. application Ser. No. 09/221,106, filed on Dec. 23, 1998, now abandoned. The priority of these prior applications is expressly claimed and their disclosure are hereby incorporated by reference in their entirety.

FIELD OF THE INVENTION

This invention relates to a snowboard and more particularly to a snowboard with a load distributing system that facilitates turning and stability.

BACKGROUND OF THE INVENTION

Whether on skis or a snowboard, every rider wants to be able to carve a turn as they traverse down the ski slope. Carving a turn amounts to putting the skis or snowboard on edge and then shooting through a smooth arc. World cup skiers carve their turns as they thread the gates on a slope. Advanced snowboarders carve turns as they lean deep into the mountain and drive the edge of their boards hard into the slope. Most skiers and snowboarders, however, do not carve their turns, but rather skid their ski or snowboard tails through a scraping turn.

The design of a conventional snowboard only serves to amplify the difficulty experienced by the average snowboarding while attempting to carve a turn. Based on the fact that the bindings are spaced far apart on a conventional board to enable the rider to maintain a preferred stance that facilitates balance and maneuverability, and that the size of the bindings are very small relative to the board, the load applied by the rider during a turn tends to be a point load applied through the foot/bindings and tends to only support a relative small area of the board adjacent the boot bindings. With the reaction forces being upwardly directed, the board tends to bend around the foot/bindings. Because the middle section is generally unsupported by the applied load, it tends to bend in a direction opposite to the bend of the ends of the board. As a result, the conventional snowboard is prone to flat spots and negative flex regions, which diminish the snowboard's ability to hold an edge through a carving turn.

One way manufactures of conventional snowboards have been able to achieve more uniform reaction forces along the entirety of the edge of the board and combat the problem of flat spots and negative flex regions is to make an overall stiffer board, i.e., a carving board. To master the art of turn carving with a conventional snowboard, the rider must drive the snowboard into the slope hard enough to cause it to bend in a manner that causes it to form a turn carving arc. It follows then that the stiffer the snowboard, the more difficult it will be to maneuver for overall snowboarding and, as a result, the stiffer board is less desirable for over all snowboarding.

Although a more flexible snowboard will be easier to maneuver, it will also be less stable. Because a snowboard generally has a wide body, the ends of the snowboard will naturally tend to twist as the snowboard bends as the edge of the snowboard is driven into the mountain to make a turn.

Thus, as the snowboard becomes more flexible, it tends to more readily twist and negatively bend between the bindings.

Most snowboard manufacturers appear to be using similar approaches to address these problems. With the end goal being uniform flex and reaction forces along the edge and body of the snowboard, which leads to more predictable and controllable performance and greater stability, the manufactures are going to great lengths to distribute the point loads applied to the board by the rider to greater areas along the edge of the board. Some of the approaches used by these manufactures include varying the thickness of the board or utilizing a variety of different stiffening methods, e.g., torsion forks and ribs within the board, in combination with different orientations and different materials throughout the board. The most popular board design appears to include making the segments of the board where the boot bindings are mounted thicker than the middle and end segments of the board. The thickened boot/binding segments of the board tend to distribute more of the load from the rider over a greater portion of the edge of the board. However, given the standard mounting method for boot bindings on the typical snowboard, it is very difficult to distribute the rider's load uniformly to a great enough area on the board to get uniform flex without making a very stiff board or a board having extreme variations in the thickness and stiffness across the board's laminate construction. In addition to being quite costly to manufacture, such laminate construction would likely have difficulty surviving the thrashing a snowboard experiences without the occurrence of innerlaminer sheer, which would likely result in board failure.

Therefore, it would be desirable to have a snowboard that facilitates uniform flex and reaction forces along the edge and body of the snowboard, that performs more predictably and controllably, that facilitates turn carving without reducing the snowboard's stability, that provides better edge hold through a turn, and that has a softer more forgiving overall feel but is able to maintain consistent edge hold when the board is pushed aggressively at higher speeds when reaction forces become greater.

SUMMARY OF THE INVENTION

The snowboard of the present invention serves to facilitate turn carving by distributing the load applied by the rider over a much greater portion of the edge of the board and, thereby, reduces the negative running edge (i.e., flat spots and negative flex regions) of the snowboard without reducing the snowboard's stability. Furthermore, the snowboard of the present invention also serves to facilitate uniform flex and reaction forces along the edge and body of the snowboard, which tends to result in more predictable and controllable performance, a softer more forgiving overall feel and the ability to maintain consistent edge hold when the board is pushed aggressively at higher speeds when reaction forces become greatest. The snowboard preferably includes a load distributing system operably mounted on the board wherein the system includes a drive base that is operably coupled to a boot binding and is adapted to distribute a load applied by a rider to multiple locations along the edge of said body. The drive base preferably includes a central cross member and first and second elongated leg members extending outwardly from its heel and toe locations and preferably pivotally mounted to the board. The drive base may be formed integrally with the binding or, alternatively, be formed as a separate insertable member.

The load distributing system enables the rider's load to be distributed to specific locations as needed to achieve a much wider range of performance goals. Within a conventional board you could not achieve a specific stiffness when the board flexes up from its static position versus when it flexes down from its static position. With the load distributing system of the present invention you have the ability to load specific areas of the board under specific situations and transmit reaction forces from one specific area to another specific area of the board. It is also possible to be very specific when and how each individual area of the board is loaded to achieve optimal results when using the spider mount drive system. This all can be achieved while reducing the complexity of the construction of the snowboard. The snowboard can be made cost effectively and still achieve a high level of performance over a much wider range of conditions because of the ability to change snowboard's flex characteristics through the use of the spider mount drive system.

An alternative load distributing system of the present invention also serves to facilitate turn carving by increasing the ratio of the positive running edge of the snowboard to the negative running edge of the snowboard without reducing the snowboard's stability. The load distributing system preferably increases the stiffness of the snowboard in an area between the boot binding mounts by directing a turning load inwardly toward the central axis of the snowboard and outwardly toward the edges of the snowboard. The stiffness of the area of the snowboard between the boot binding mounts is preferably increased by mounting V-shaped, diamond-shaped, or T-shaped drive members to the body or integrally forming the V-shaped, diamond-shaped, or T-shaped members with the body. The load distributing system may also include first and second bases mounted in spaced relation on the snowboard body on opposite sides of the central axis of the snowboard. The first and second bases can be mounted to the snowboard along with bindings utilizing the conventional mounting holes of a conventional snowboard. The first and second bases preferably elevate the snowboarder's boots captured in the bindings above and in spaced relation with the body of the snowboard.

By elevating the snowboarder's boots and increasing the stiffness of the body between the first and second bases, the flex area and positive running edges of the snowboard are increased as compared to a conventional snowboard. The positive running edge on the snowboard of the present invention tends to extend toward the central axis of the snowboard beyond the first and second bases resulting in the formation of a smooth carving arc during turning of the snowboard. Additionally, stiffener fingers that extend from the first and second bases toward the ends of the nose and tail sections can be added to provide shock absorption and vibration dampening. The stiffener fingers can be mounted on the body or formed integrally therewith.

An object of this invention is to provide an improved snowboard and load distributing system.

Further objects and advantages of the present invention will become apparent from a consideration of the drawings and ensuing description.

DESCRIPTION OF THE PRIOR ART

Figure 1:
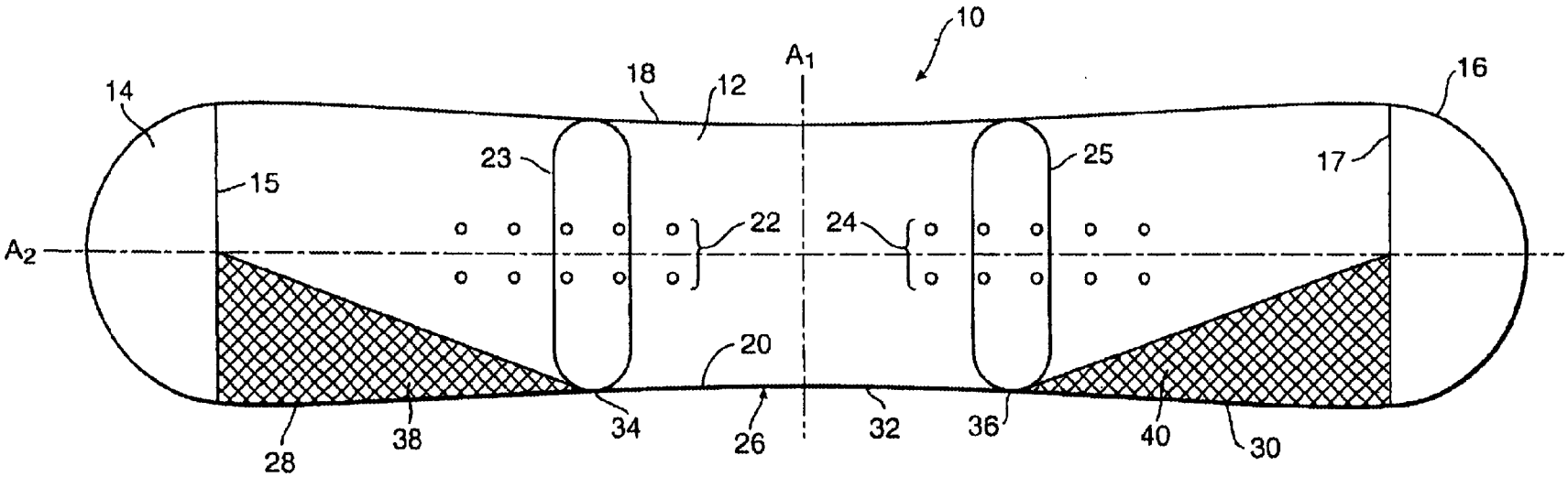
FIG. 1 (Prior art)
FIG. 1 is a top view of a conventional snowboard known in the art.
Figure 2:
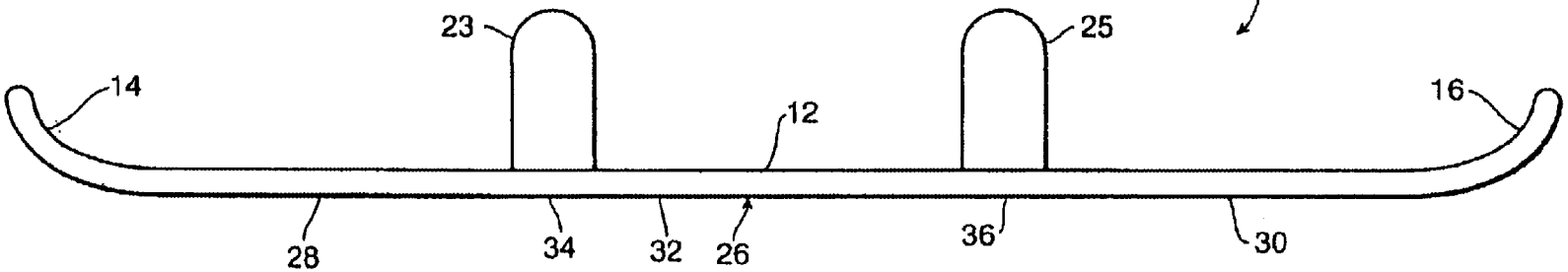
FIG. 2 (Prior art)
FIG. 2 is an elevation view of the conventional snowboard in FIG. 1.
Figure 3:
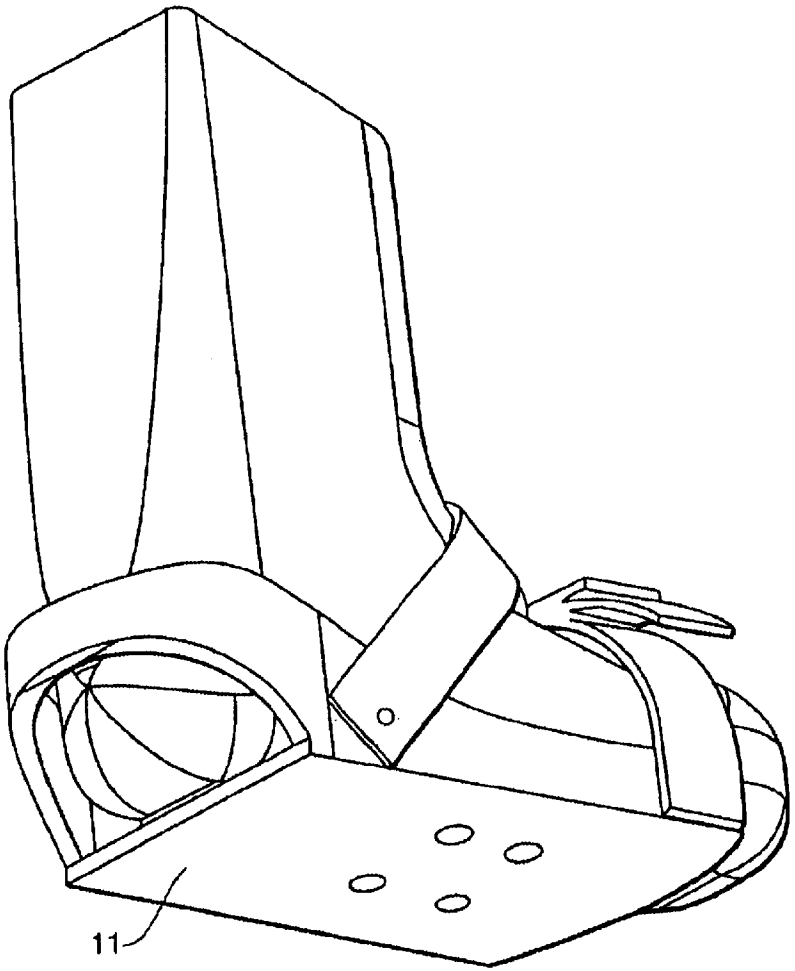
FIG. 3 (Prior art)
FIG. 3 is an isometric view showing a conventional boot and binding.
Figure 4:
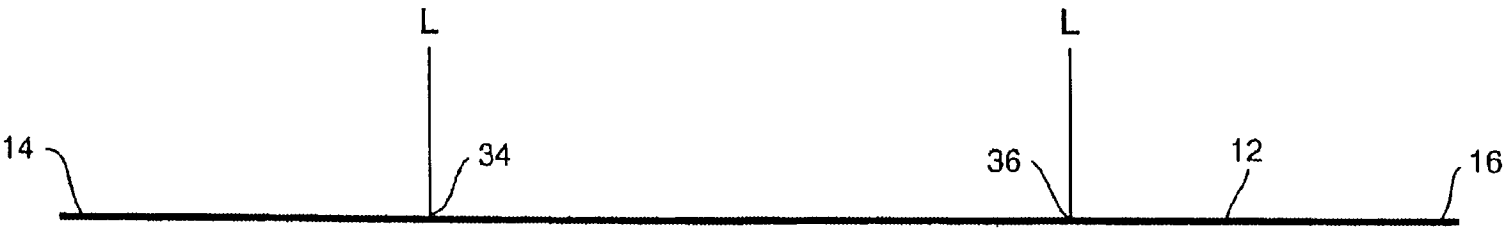
FIG. 4 (Prior art)
FIG. 4 is a schematic showing the load points along a running edge of the conventional snowboard prior to turning.

Referring now in detail to FIGS. 1–6, therein illustrated is a conventional snowboard 10 known in the art. The snowboard 10 typically comprises an elongated planar body 12 having arcuate or parabolically cut sides 18 and 20. The body 12 is generally wider than a conventional alpine ski known in the art. The ends 14 and 16 of the nose and tail of the body 12 tend to be curved upwardly at bend lines 15 and 17. Two groups of mounting holes 22 and 24 are positioned in spaced relation and on opposite sides of the central axis $A_1$ of the snowboard 10 and tend to straddle the longitudinal axis $A_2$ of the snowboard 10. Bindings 11 (see FIG. 3) which capture boots 23 and 25 are mounted to the snowboard 10 using mounting holes 22 and 24. Conventional bindings 11 tend to include a generally rectangular base or footprint. The boots 23 and 25 are shown schematically in FIG. 2 to illustrate the typical spacing between boot 23 and 25 locations on conventional snowboards 10.

Figure 5:
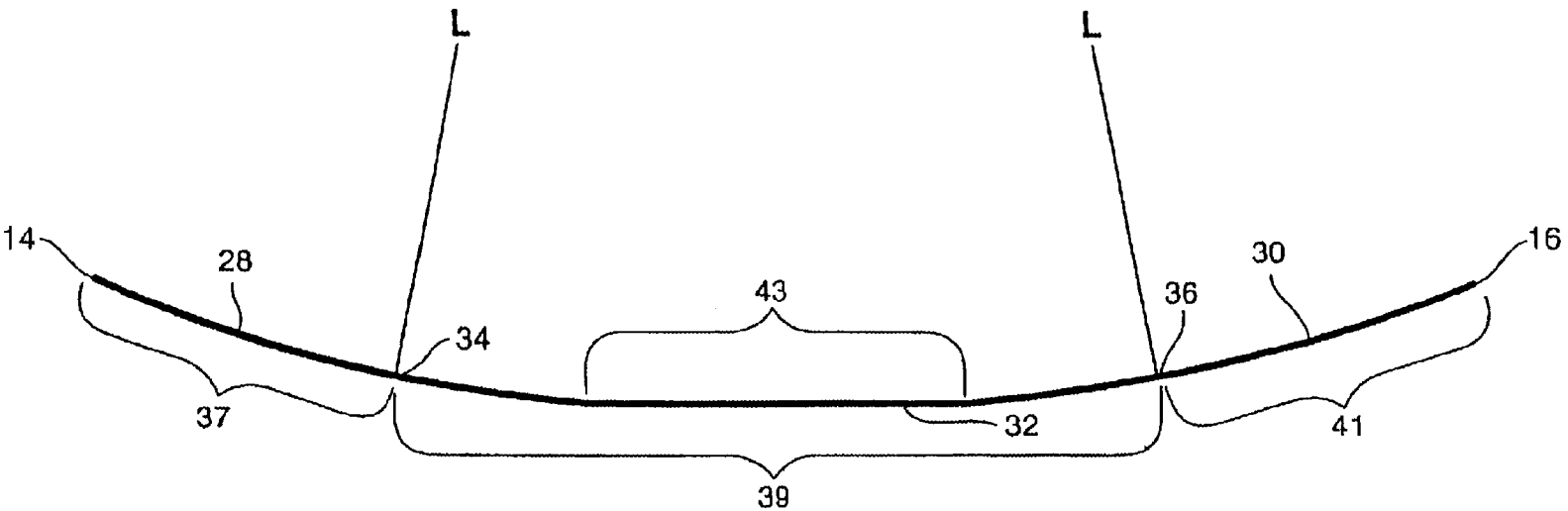
FIG. 5 (Prior art)
FIG. 5 is a schematic showing the load points along the running edge and the resulting shape of the running edge of the conventional snowboard during turning.
Figure 6:
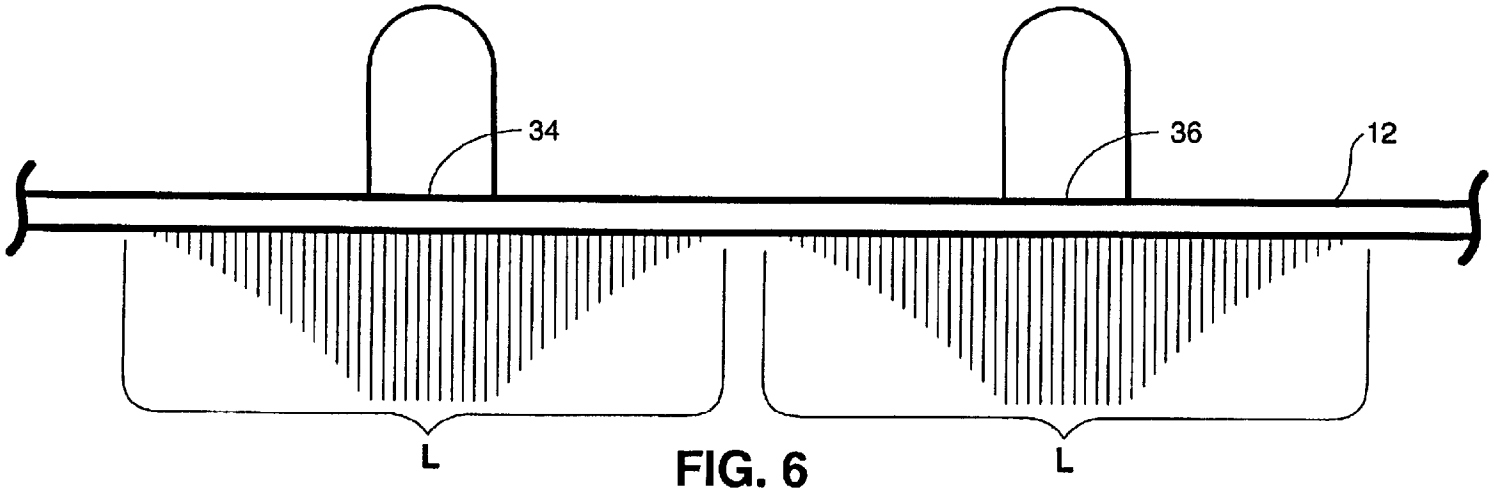
FIG. 6 (Prior art)
FIG. 6 is a schematic showing the load distribution along the edge of a conventional snowboard.

To perform a turn, the snowboarder rolls the snowboard 10 up on its running edge 26 and leans into the turn. By leaning, the snowboarder applies a load L to the body 12 of the snowboard 10 at points 34 and 36 along the running edge 26 adjacent to the toe end of the boots 23 and 25. As shown in FIG. 6, the applied load L is greatest directly under the boot/binding at load points 34 and 36, but greatly diminishes along the board as you move away from the load points 34 and 36 and, thus, it can be seen that the load L tends not to be distributed over significant portions of the board. As a result, the applied load L causes the body 12 of the snowboard 10 to flex in the cross-hatched areas 38 and 40 between respective load points 34 and 36 and the bend lines 15 and 17 of the ends 14 and 16. The flex of the body 12 of the snowboard 10 includes a twisting motion around the longitudinal axis $A_2$ and a bending motion around the central axis $A_1$. When referring to FIG. 5, the bending motion will direct the ends 14 and 16 in an upwardly direction forming arcs that are directed downwardly. However, as the load is applied at load points 34 and 36 it effectively divides the board 12 into three segments 37, 39 and 41. Because the central segment 39, which is relatively unsupported by the load applied by the rider and, thus vulnerable to negative bending, is reacting to the same force as the end segments 37 and 41, it will tend to bend around the boot/bindings as do the end segments 37 and 41 and define an arc that curves in a direction opposite to the arc defined by the end segments 37 and 41. As a result, the central segment 39 of the body 12 of the snowboard 10, located between the boots 23 and 25, includes a portion 43 that will either tend not to flex (flat spot) or will tend to bend in a direction opposite to the direction that the ends 14 and 16 bend, resulting in a non-uniform flex along the running edge 26.

The flex areas 38 and 40 define areas of a positive running edge 28 and 30 along the running edge 26. The positive running edges 28 and 30 are smooth shaped arcs, which guide the snowboard in a turn. However, the area between the boots 23 and 25 includes a negative or non-flex portion 43 that defines a negative running edge 32. The negative running edge 32 is either flat or slightly curved in an opposite direction to the positive running edges 28 and 30 as shown in FIG. 5, and tends to prevent the snowboard 10 from holding an edge through a turn defined by an arcuate path. Thus, the shape of the running edge 26 during a turn, as shown in FIG. 5, causes the conventional snowboard 10 to slide or skid through a turn rather than following a defined path through a smooth turn carving arc.

Efforts to achieve a uniform flex along the running edge 26 of the snowboard 10 by simply stiffening the body 12 would tend to only serve to make it more difficult for the average rider to carve a turn. Other efforts to achieve a uniform flex along the running edge 26 include thickening the boot/binding portions of the body 12 relative to the central portion 32 and end portions 28 and 30 to distribute more of the load from the rider over a greater portion of the edge of the board. However, given the standard mounting method for boot bindings on the typical snowboard, it is very difficult to distribute the rider's load uniformly to a great enough area on the board to get uniform flex without making a very stiff board or a board having extreme variations in the thickness and stiffness across the board's laminate construction. In addition to being quite costly to manufacture, such laminate construction would likely have difficulty surviving the thrashing a snowboard experiences without the occurrence of innerlaminar sheer, which would likely result in board failure.

DESCRIPTION OF THE PREFERRED EMBODIMENT

Figure 7:
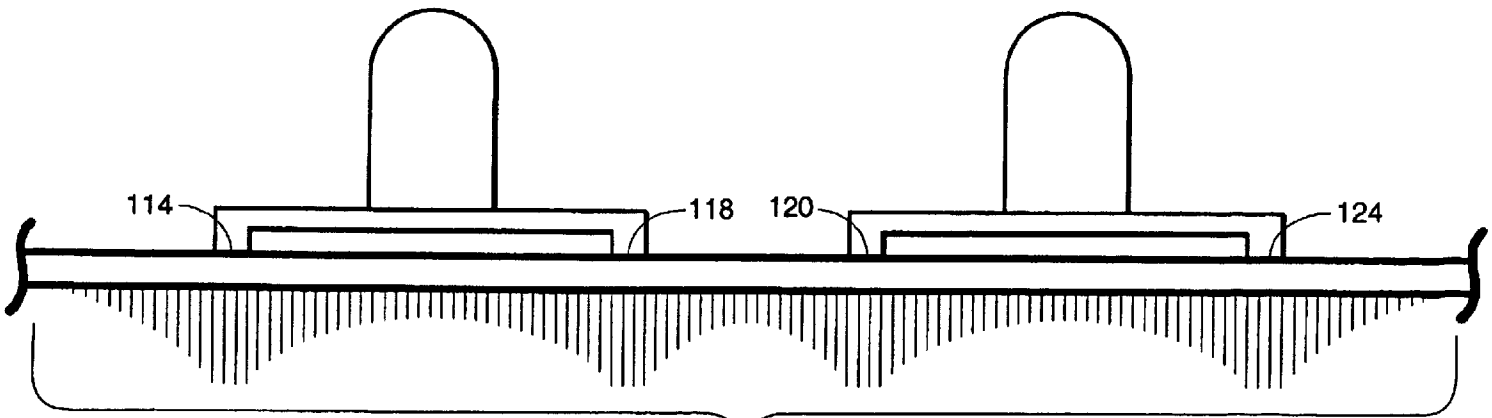
FIG. 7 is a schematic showing the load distribution along the edge of a snowboard of the present invention.
Figure 8:
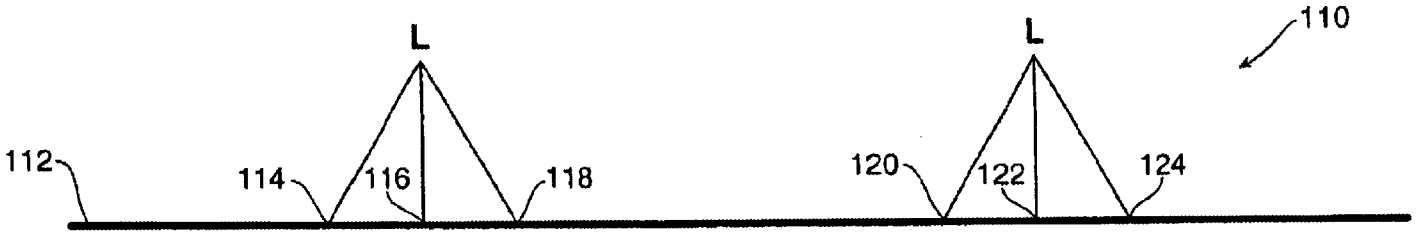
FIG. 8 is a schematic showing the load points along the running edge of a snowboard of the present invention prior to turning.
Figure 9:
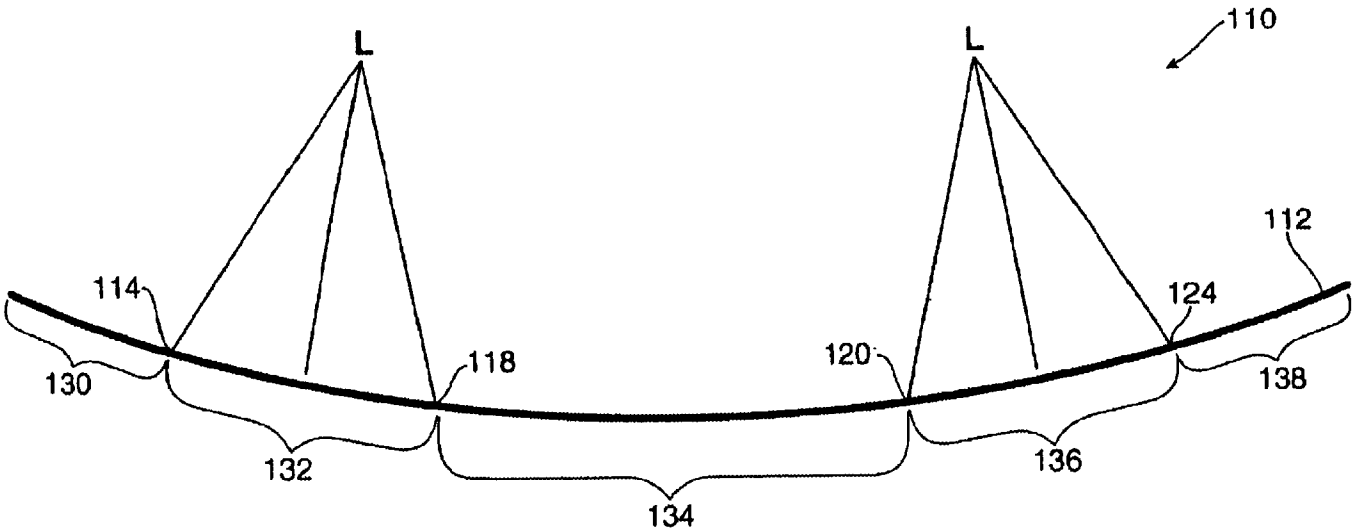
FIG. 9 is a schematic showing the distributed load points along the running edge of a snowboard of the present invention during turning.

As shown in FIGS. 7, 8 and 9, the goal of the present invention is to take the load L that is being applied to the body 112 of a snowboard 110 by the rider and distribute that load over multiple locations 114, 116, 118, 120, 122, and 124 on the board to achieve a much wider range of performance goals. The invention takes the two locations 116 and 122 on the edge of the snowboard that conventional boards are currently loaded and divides these two loads L and applies them at multiple load points 114, 116, 118, 120, 122, and 124 distributed over a greater portion of the edge. Loading the board at multiple locations, as opposed to loading the board at the inherent locations defined by the standard mounting holes and method of attaching the binding to a conventional board, tends to result in a greater distribution of the load L along the entirety of the board (see FIG. 7), which in turn tends to result in a more uniform and consistent flex along the entirety of the board (see FIG. 9).

In operation, as the board is rolled up on its edge and begins to bend, the load L tends to be distributively applied at the four load points 114, 118, 120, and 124. By distributing the load to these multiple locations, the board can be broken down into five (5) or more generally equally loaded segments 130, 132, 134, 136, and 138. By maintaining specific segment lengths, the distance between two (2) load points or the distance between a load point and the end of the board, the entirety of each segment is less likely to be unsupported by the applied load L and, thus, the board tends to be less prone to experience flat spots or negative bend areas typical of conventional boards. Moreover, distributing the load over a greater area of the edge of the board tends to maintain a higher and more uniform reaction force along the edge of the board that enables the rider to ride a generally more controllable and predictable board that has a generally softer, more forgiving overall feel, but is able to maintain a consistent edge hold when the board is pushed aggressively at higher speeds when reaction forces are greatest.

Figure 10:
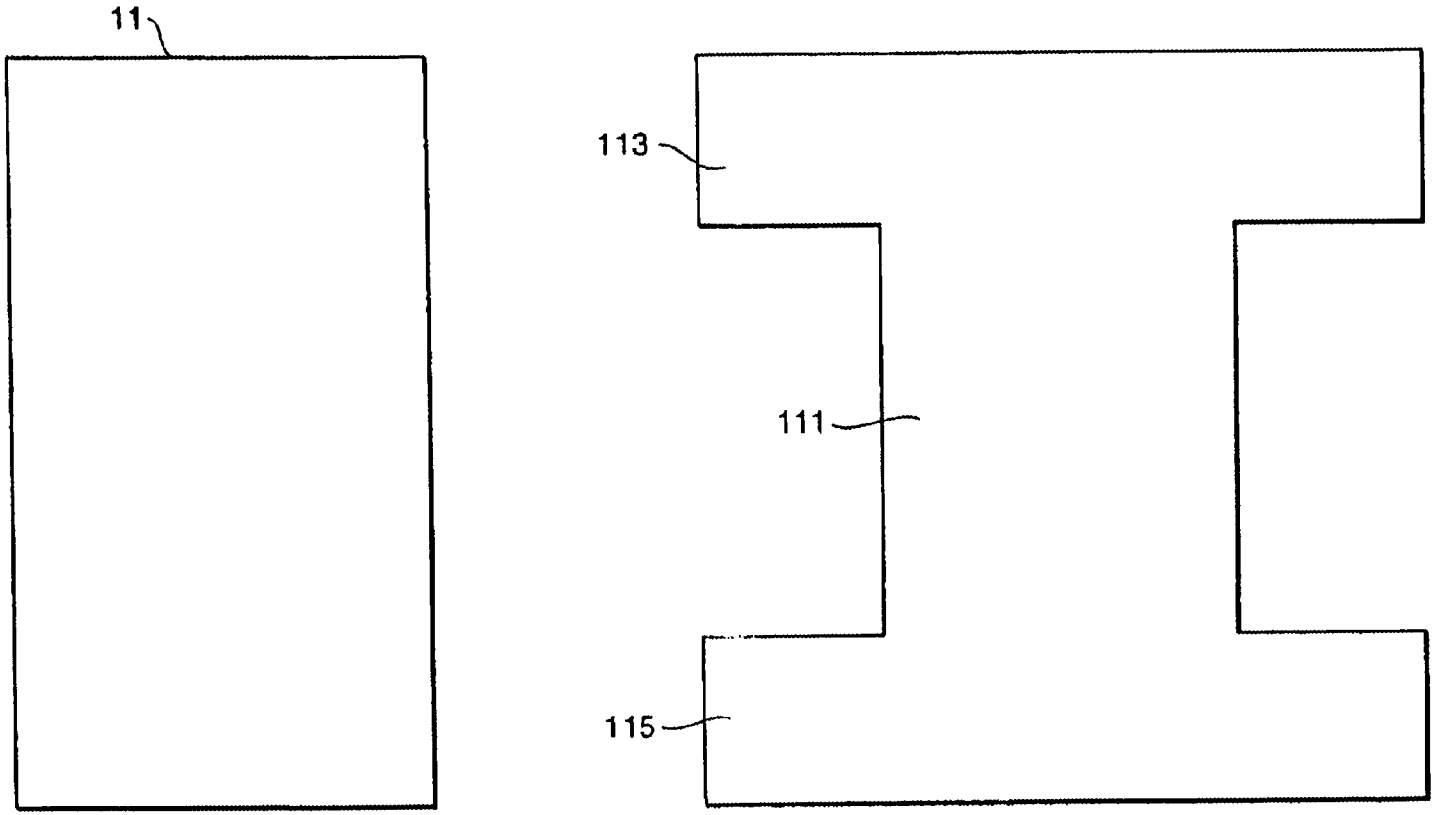
FIG. 10 is a plan view showing the footprints of a convention binding and the drive base of the present invention.

As shown in FIG. 10, to accomplish the goal of the present invention to distribute the applied load L to a greater area along the edge of the board, it is preferable to provide a drive base with footprint 111 that differs from the footprint 11 of a conventional binding. Although the specific shape of the footprint 111 of the drive base of the present invention tends to be insignificant, it is preferable that the cross members 113 and 115 of the footprint extend along a greater area of the edge of the board than is covered by the width of the footprint 11 of a conventional board. Preferably, the footprint 111 of the drive base of the present invention is in the shape of an "I" and the cross members have a stiffness that is greater than the stiffness of the snowboard.

Referring now in detail to FIGS. 11–14, therein illustrated is a preferred embodiment of a snowboard 110 of the present invention. The snowboard 110 of the present invention is nothing more than a conventional snowboard of typical laminate construction that is cost effective to produce and that can withstand the rigors of operation without the concern for innerlaminer sheer. Because the distribution of the rider's load is accomplished by utilizing the load distributing system 140 of the present invention, it tends to be unnecessary for the snowboard of the present invention to comprise any extreme variations in stiffness or thickness across its laminate construction.

Figure 11:
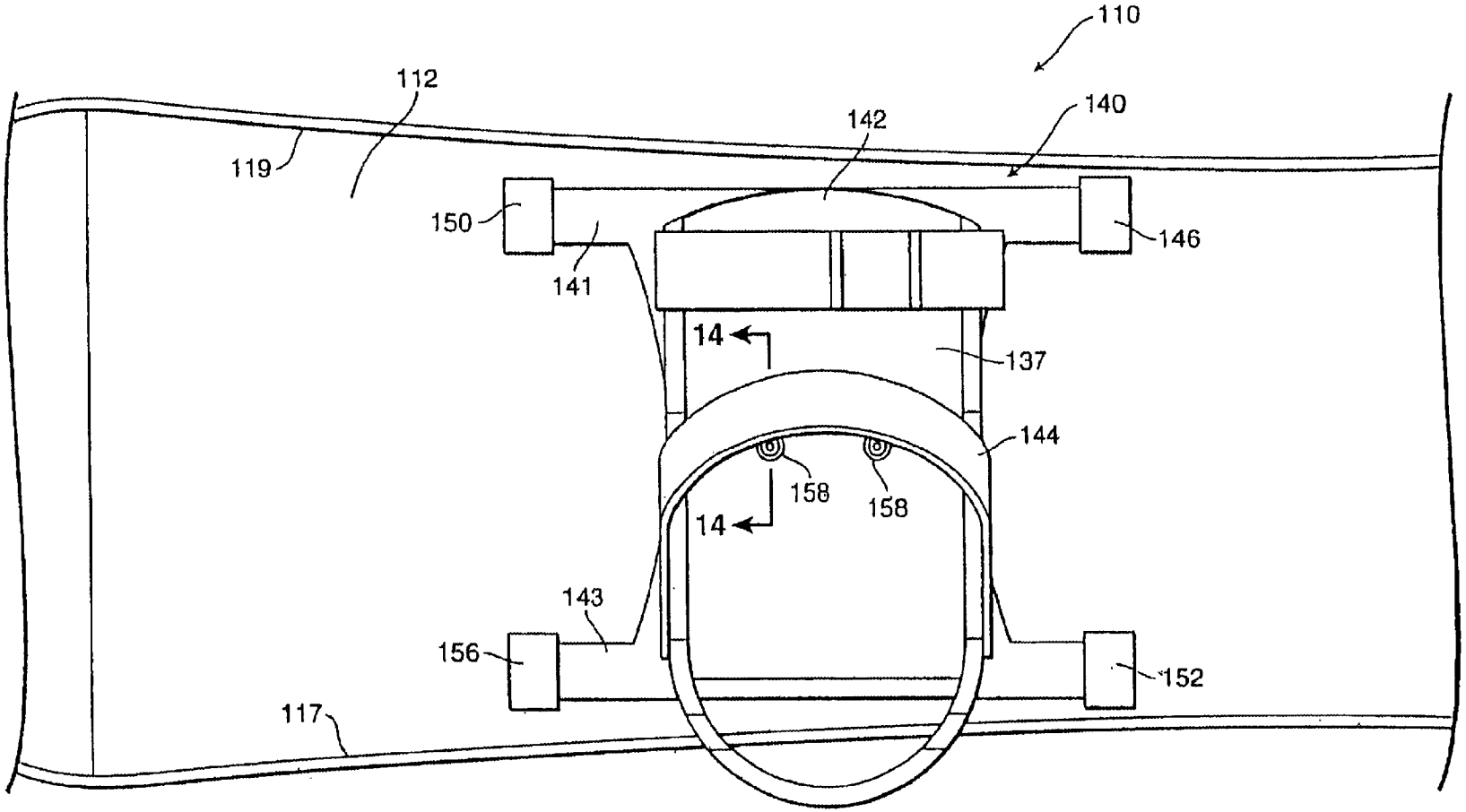
FIG. 11 is a partial top view of the snowboard of the present invention showing a spider mount boot binding combination mounted on the snowboard.
Figure 12:
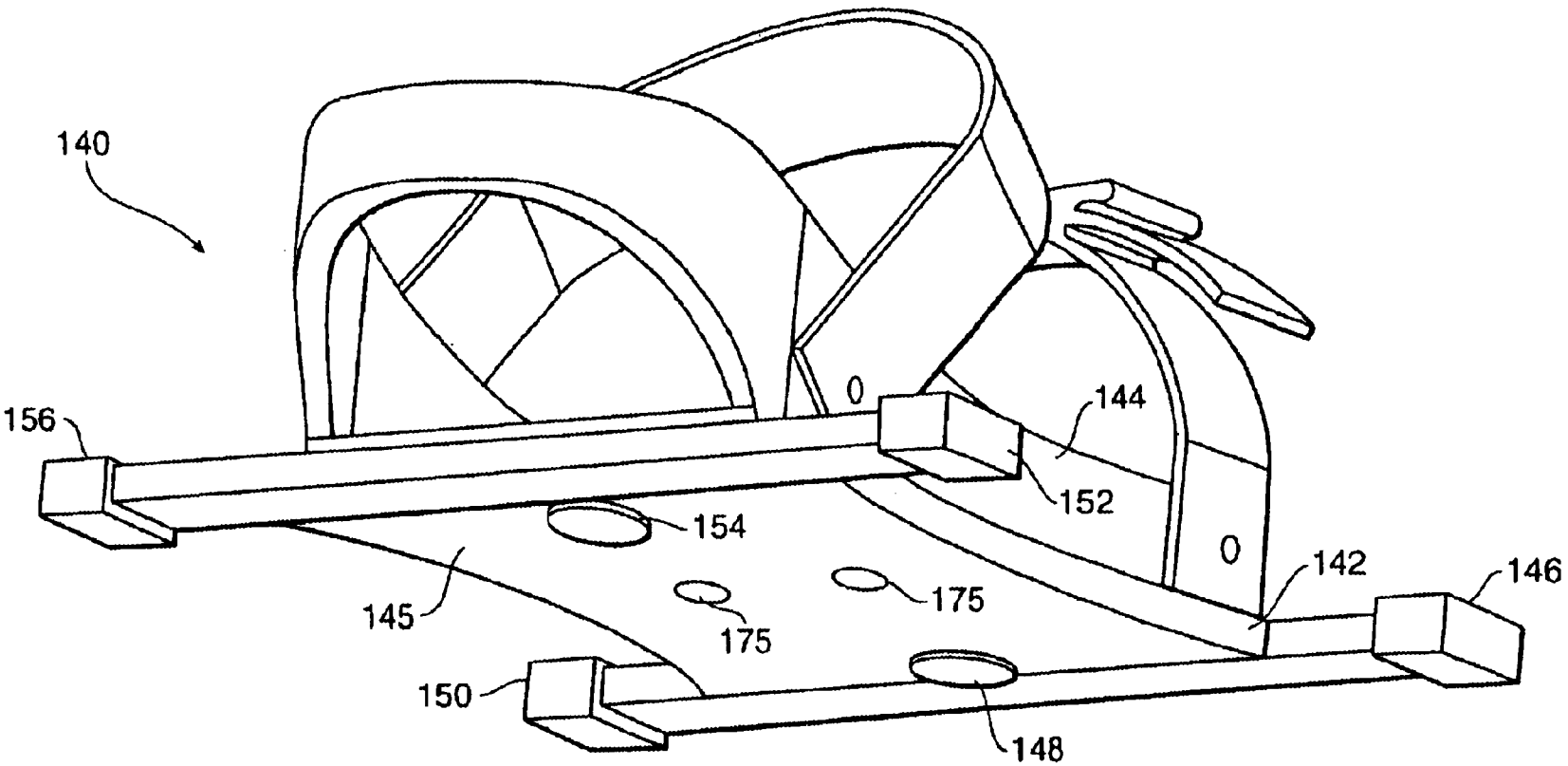
FIG. 12 is an isometric view of the spider mount boot binding combination of the present invention.

Turning to FIGS. 11 and 12, the load distributing system 140 of the present invention preferably comprises a spider mount base 142 integrally formed with a conventional boot binding 144 wherein the spider mount base 142 acts as the base of the boot binding 144. The spider mount base 142 is preferable formed from materials commonly used to form conventional boot bindings.

Figure 13:
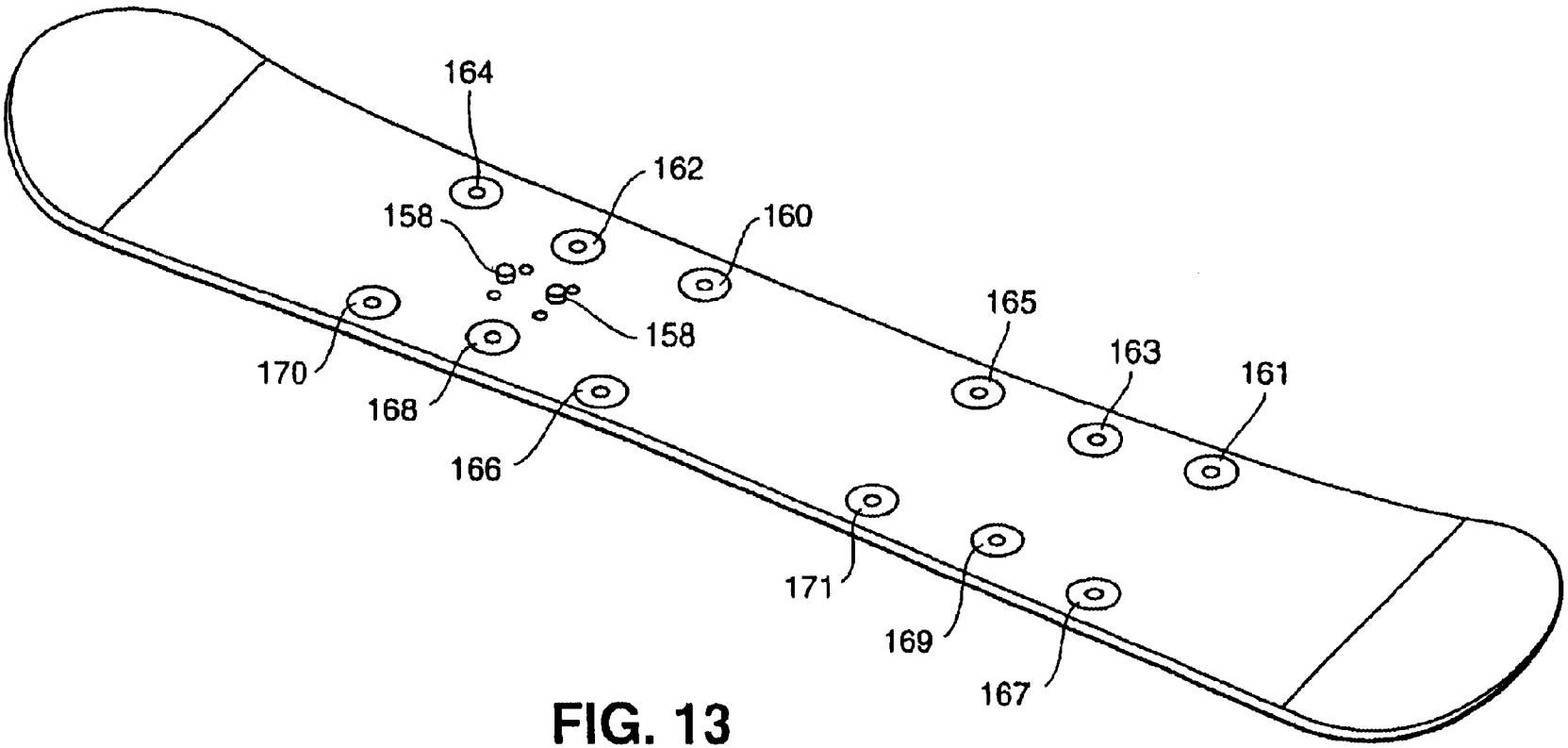
FIG. 13 is an isometric view of the snowboard of the present invention showing mounting pins and influential contact points.

The specific shape of the spider mount base 142 tends to be insignificant. However, it should be sized to generally extend between the edges 117 and 119 of the board 112 and extend along each of the edges 117 and 119 a sufficient amount to enable the distribution of the load applied by the rider over a generally much greater area of the edges 117 and 119 of the board 112 then occurs with conventional bindings. Preferably, the spider mount base 142 of the present invention is shown to include a central cross member 137 and a pair of elongated legs 141 and 143 formed at the toe and heel locations of the base 142. Preferably, the elongated legs 141 and 143 extend outwardly from the central cross member 137. In addition, the base 142 preferably includes three individual feet formed on the underside 145 of the base 142 on or adjacent the opposing toe and heel legs 141 and 143. The feet include first 146, second 148 and third 150 foot members of toe leg 141 and fourth 152, fifth 154 and sixth 156 foot members of heel leg 143 of the base 142. The feet can be formed either as a thickening of material of the base 142 at these locations or by attaching spacer pads of material similar to the base 142 at these locations. Depending upon which edge 117 and 119 the rider rolls the snowboard 110 up on, the load applied by the rider will be distributively applied to the body 112 of the board 110 at influential contact points 160, 162, 164, 166, 168, and 170 through corresponding spider mount feet 146, 148, 150, 152, 154, and 156. A second set of influential contact points 161, 163, 165, 167, 169, and 171 on the body 112 of the snowboard 110, as shown in FIG. 13, correspond to the feet of a second spider mount base (not shown). As the board begins to flex about the legs 141 or 143 of the base 142, the load tends to be applied through the outer foot members 146 and 150 or 152 and 156.

Figure 14:
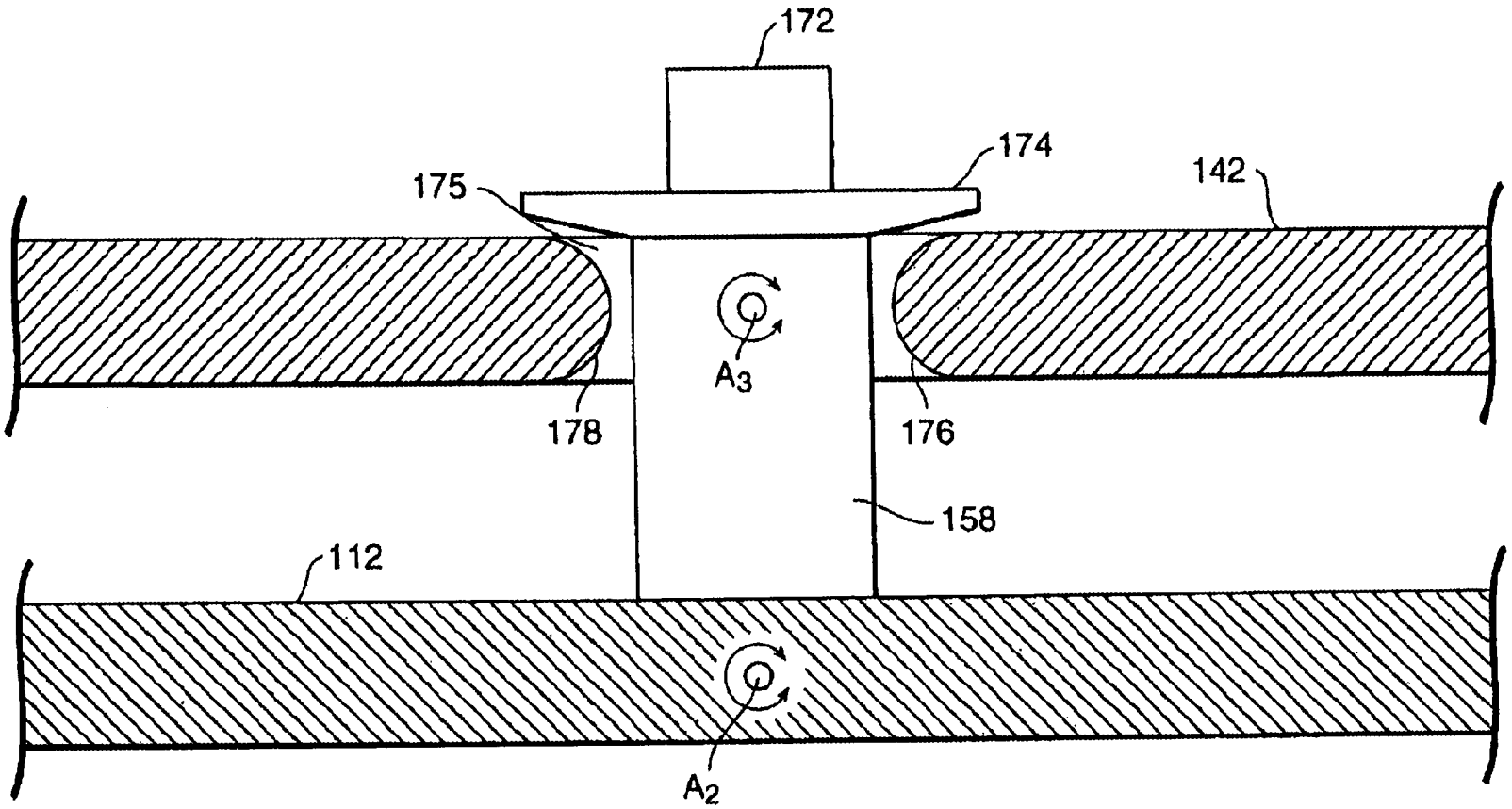
FIG. 14 is a partial elevation view of the snowboard of the present invention showing the interaction between the spider mount base and mounting pins.
Figure 15:
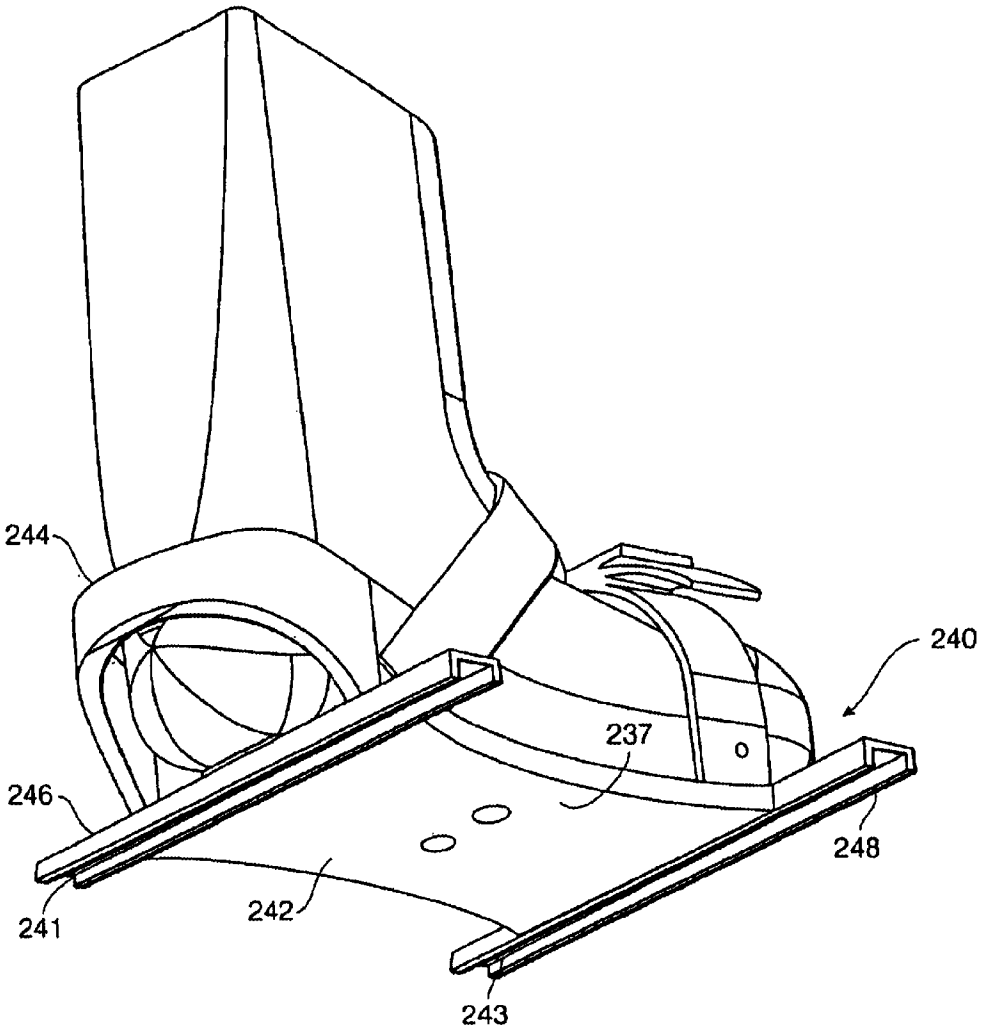
FIG. 15 is an isometric view showing an alternate embodiment of the spider mount boot binding combination of the present invention.
Figure 16:
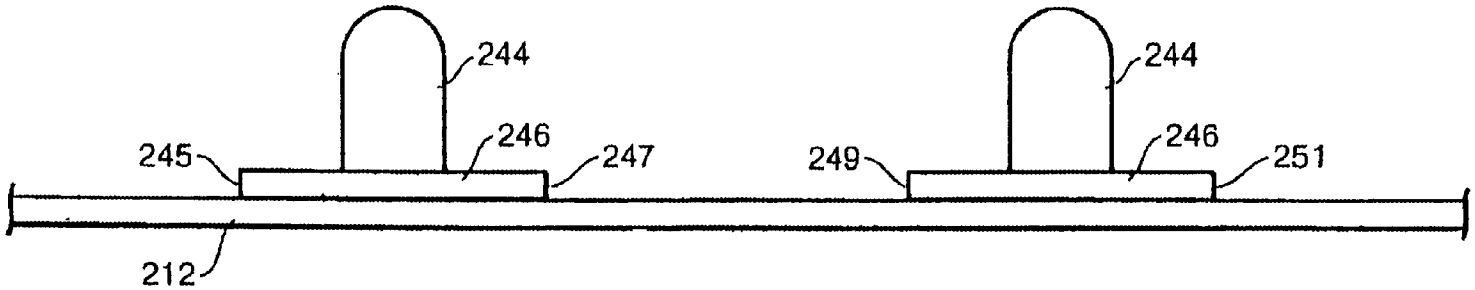
FIG. 16 is an elevation view showing a snowboard and spider mount boot binding of FIG. 15 in an unloaded state.

As shown in detail in FIG. 14, the spider mount base 142 is preferably pivotally mounted to the body 112 of the board 110 on vertically extending mounting pins 158(see also FIGS. 11 and 13). Mounting holes 175 having arcuate sidewalls 176 and 178 are formed in the spider mount base 142. The spider mount base 142 is slidably received over the mounting pins 158 as the mounting pins pass through the holes 175. The spider mount base 142 is retained on the mounting pins 158 by washers 174 fixedly mounted on the mounting pins 158 by bolts screwed into the upper end of the mounting pins 158. There is enough play along the mounting pins 158 to enable the spider mount base 142 to rotate or rock like a teeter-totter about an axis A3 that is parallel to the longitudinal axis A2 of the board. Because there are multiple pins along the A3 axis, the binding is constrained to only teeter about the A3 axis. By pivotally mounting the spider mount base 142 to the board, the spider mount drive mechanism 140 does not affect the overall stiffness of the board. The feet and legs of the base 142 are able to move freely on the board, and therefore no portion of the board is tied up by rigidly attaching the spider mount base 142 to the board. As a result, the load is only applied through the feet of the spider mount base 142 to the influential contact points along the board.

In operation, the primary load applied to the pins will be pulling them vertically. Without either side contacting the board, the binding can teeter freely. As the rider starts to roll the board up on one of its edges, a gap will develop between the board and the feet of the spider mount on the side of the spider mount base opposite the edge of the board that is contacting the snow. Once the gap develops, the base is no longer constrained and is able to teeter about the pins. As the base rocks toward the edge in contact with the snow, the load applied by the rider is applied through the feet of the spider mount base to the influential contact points along the same edge. With the legs of the spider mount base being stiffer than the body of the snowboard, the board, as shown in FIG. 9, will tend to uniformly flex about the outer feet such that a gap forms between the board and the central foot of the spider mount base. As a result, the load is distributively applied by the outer feet of the spider mount base to a greater area along the edge of the board.

Figure 17:
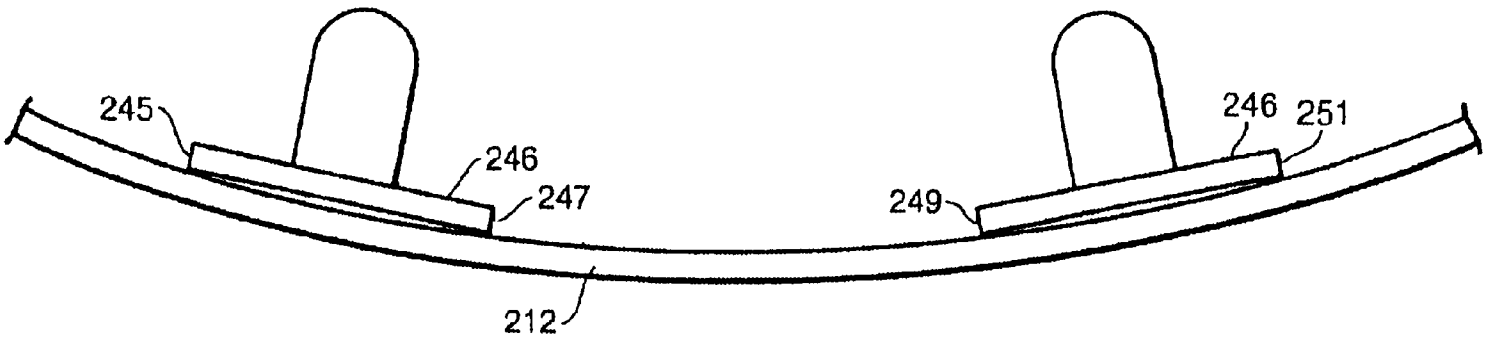
FIG. 17 is an elevation view showing a snowboard and spider mount boot binding of FIG. 15 in a loaded state.

Referring to FIGS. 15–19, an alternate embodiment of the load distributing system 240 of the present invention is shown to alternatively not include raised feet on the underside of the base. The base 242 includes a central cross member 237 and first and second elongated leg members 246 and 248 attached to or formed integrally the central cross member 237 at the heel and toe locations of the base 242. The base 242 can be mounted to the body 212 of the board using standard binding mounting methods or may be pivotally mounted in a manner discussed above. Regardless of the mounting method, when loaded, the board will tend to uniformly flex about the foot members 246 and 248. As shown in FIG. 17, as the board is rolled up on its heel edge, the body 212 tends to flex about the leg members 246 and as a gap forms between the base 242 and the body 212, the load tends to be evenly distributed to and applied to the board through the endpoints 245, 247, 249, and 251 of the leg members 246 to the board. By applying the load at the endpoints of the foot members 246 and 248, the load applied by the rider through the boot/binding is distributed over a greater portion of the edge of the body 212 of the snowboard resulting in a more uniform flex and more controllable and predictable performance.

Figure 18:
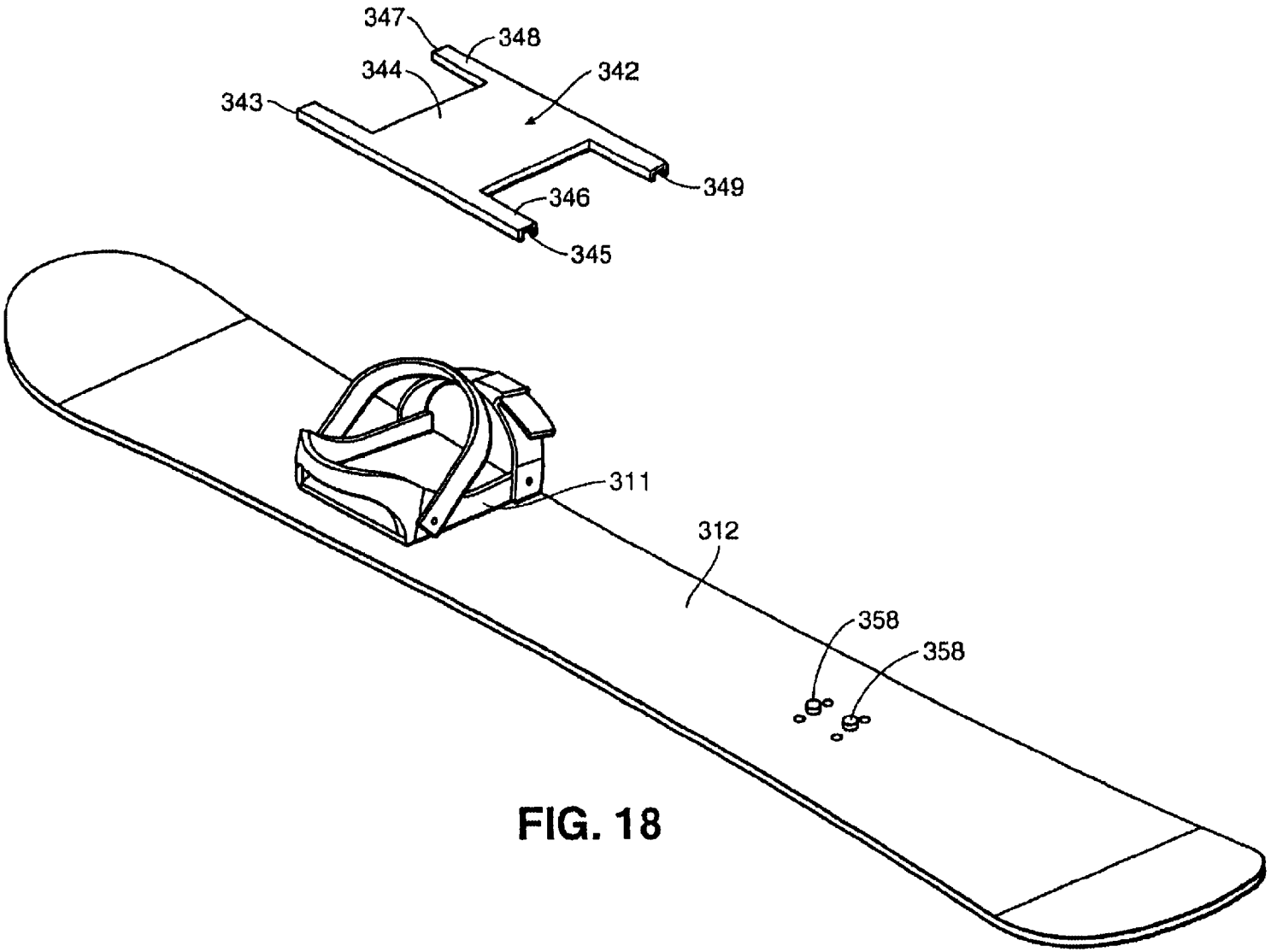
FIG. 18 is an exploded isometric view of an alternate embodiment of the present invention showing a spider drive base, binding and snowboard.
Figure 19:
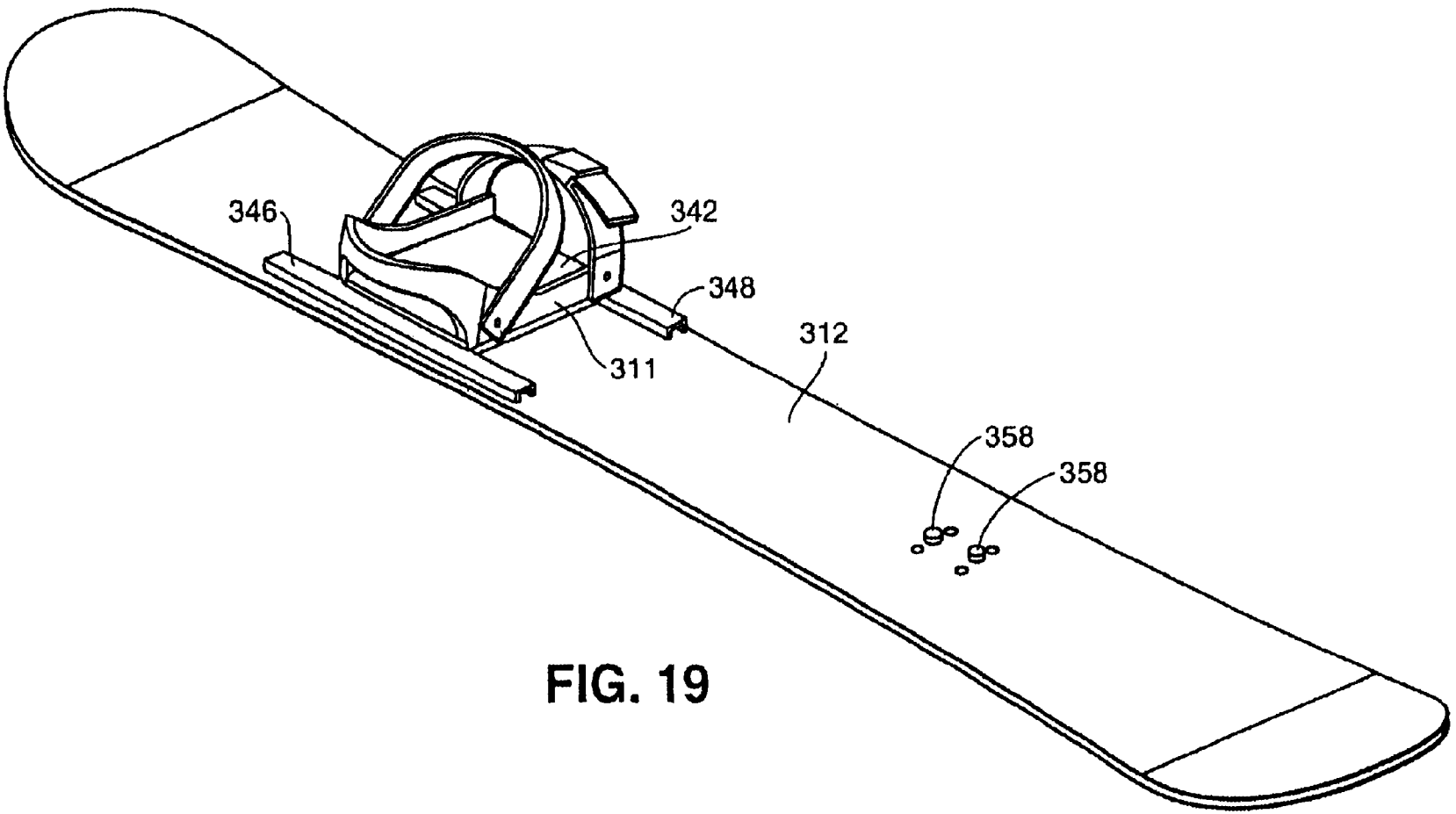
FIG. 19 is an assembled isometric view showing the spider drive base, binding and snowboard of FIG. 18.
Figure 20:
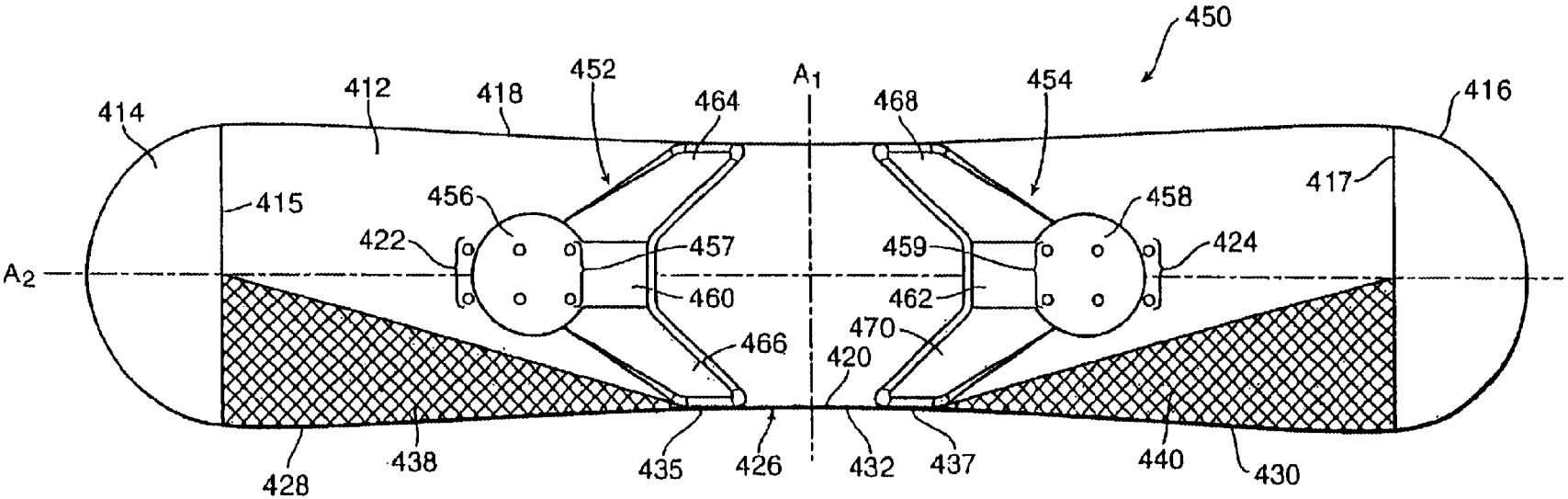
FIG. 20 is a top view of a novel V-drive snowboard of the present invention.

Alternatively, an embodiment of the present invention shown in FIGS. 18 and 19 includes a spider drive base 342 that is adapted to be insertable between the bottom of a rider's boot and the base of the conventional binding 311. Preferably, the spider drive base 342 is formed in the general shape of an "I" and constructed from aluminum, graphite or some other material known in the art. The binding is only needed to secure the boot in place and fix its orientation. The spider drive base 342 supports the weight of the rider and is preferably releaseably fixed to the base of a conventional binding 311 in a manner known in the art. Alternatively, the spider drive base 342 could be pivotally mounted to the binding 311 using mounting pins 358 in a manner described above or, alternatively, mounted between the board 312 and the binding 311.

The spider drive base 342 comprises a central cross member 344 and elongated leg members 346 and 348 formed at the opposing heel and toe ends of the cross member 344 to form the spider drive base's 342 "I" shape.

The elongated leg members 346 and 348 are preferably stiffer than the board itself. When inserted in its operable position, the central cross member 344 of the spider drive base 342 extends across the base of the conventional binding 311 towards the edges of the snowboard. The foot members 346 and 348 are wider than the width of the conventional binding and, therefore, extend over a greater area of the edge of the board 312.

In operation, as the rider rolls the board 312 up on its edge and, thus, applies a load to the board through the spider drive base 342, the board, depending on which edge it is rolled up on, will tend to bend around the end points 343 and 345 or 347, and 349 of the foot member 346 or 348, respectively. As a result, the load applied by the rider is distributed to a greater area of the board through the endpoints of the foot members of the load distributing system resulting in a more uniform flex along the edge of the board and more predictable performance.

With load distributing system of the present invention, it is possible to engineer a wide range of performance goals into the snowboard. For example, each individual foot of a spider mount base could be mechanically preloaded separate from its manufactured stiffness allowing for individual tuneability for the rider's preference. This could be achieved by adding an aluminum or graphite shim having a particular stiffness to the foot members 246 and 248 by inserting the shims into the slots 241 and 243 of the foot members 246 and 248 of the spider mount base 242 (see FIG. 15). Other alternatives include using a threaded pre-load knob to adjustably tie a foot to the body of the snowboard.

The spider mount load distributing system enables the rider's load to be distributed to specific locations as needed to achieve a much wider range of performance goals. Within a conventional board you could not achieve a specific stiffness when the board flexes up from its static position versus when it flexes down from its static position. With the spider mount you have the ability to load specific areas of the board under specific situations and transmit reaction forces from one specific area to another specific area of the board. It is also possible to be very specific when and how each individual area of the board is loaded to achieve optimal results when using the spider mount load distributing system. This all can be achieved while reducing the complexity of the construction of the snowboard. The snowboard can be made cost effectively and still achieve a high level of performance over a much wider range of conditions because of the ability to change snowboard's flex characteristics through the use of the spider mount load distributing system.

Referring now in detail to FIGS. 20–24, therein illustrated is an alternative embodiment of the load distributing system of the present invention embodied in a V-drive snowboard 450. The V-drive snowboard 450 comprises V-drives 452 and 454 mounted on a conventional snowboard.

Figure 24:
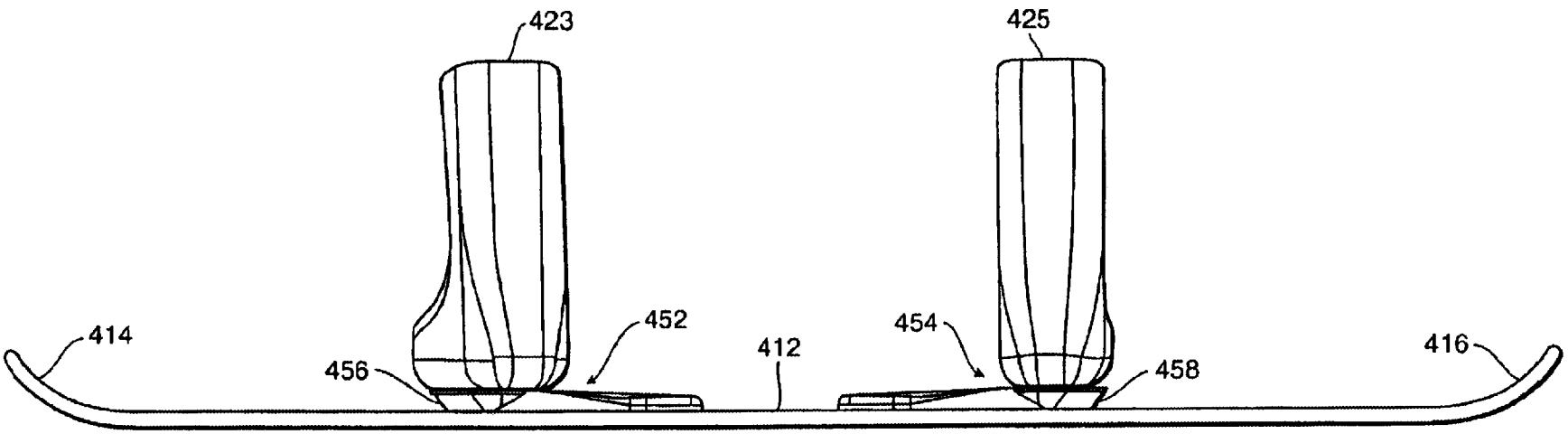
FIG. 24 is an elevation view of the V-drive snowboard in FIG. 20.

The V-drives 452 and 454 comprise torsional bases 456 and 458 and V-plates 460 and 462 extending therefrom toward the central axis A1 of the V-drive snowboard 450. The V-plates 460 and 462 comprise radially extending stiffener fingers 464 and 466, 468 and 470 that extend respectively from the torsional bases 456 and 458 inwardly toward the central axis $A_1$ of the snowboard 450 and outwardly toward the side edges 418 and 420 of the body 412 of the V-drive snowboard 450. The torsional bases 456 and 458 of the V-drives 452 and 454 include mounting holes 457 and 459 which allow the V-drives 452 and 454 to be mounted with boot bindings onto a conventional snowboard utilizing the existing mounting holes 422 and 424. By utilizing the existing mounting holes 422 and 424 the V-drive snowboard 450 preserves the conventional mounting locations for the bindings and the conventional positioning of a snowboarder's boots 423 and 425. The fingers 464, 466, 468, and 470 can also be fixed to the body 412 with epoxy or simply bolted. As shown in FIG. 24, the torsional bases 456 and 458 are advantageously elevated to raise the snowboarder's boots 423 and 425 above the body 412 of the V-drive snowboard 450. A compressive material (not shown) could be mounted between the boots 423 and 425 and the body 412 to prevent snow and ice from packing in between the elevated mount and the body 412 of the snowboard 450.

Figure 21:
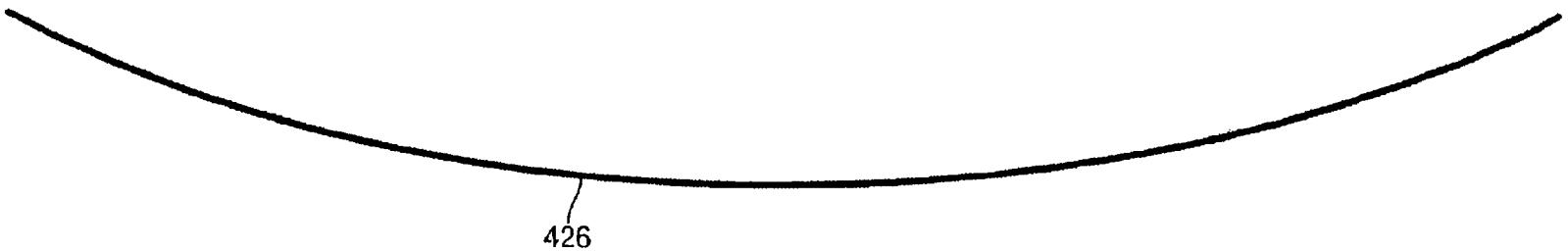
FIG. 21 is a schematic showing the shape of the running edge of the V-drive snowboard in FIG. 5 during turning.
Figure 22:
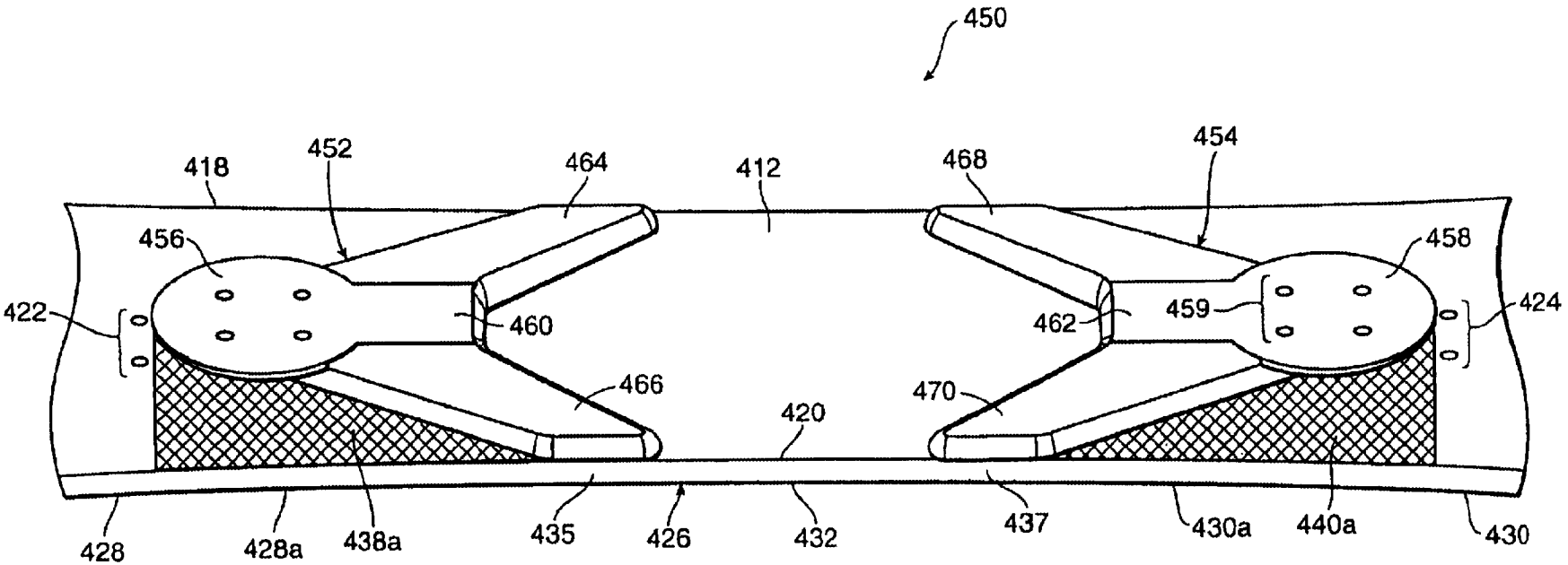
FIG. 22 is a partial top view of the V-drive snowboard in FIG. 20.
Figure 23:
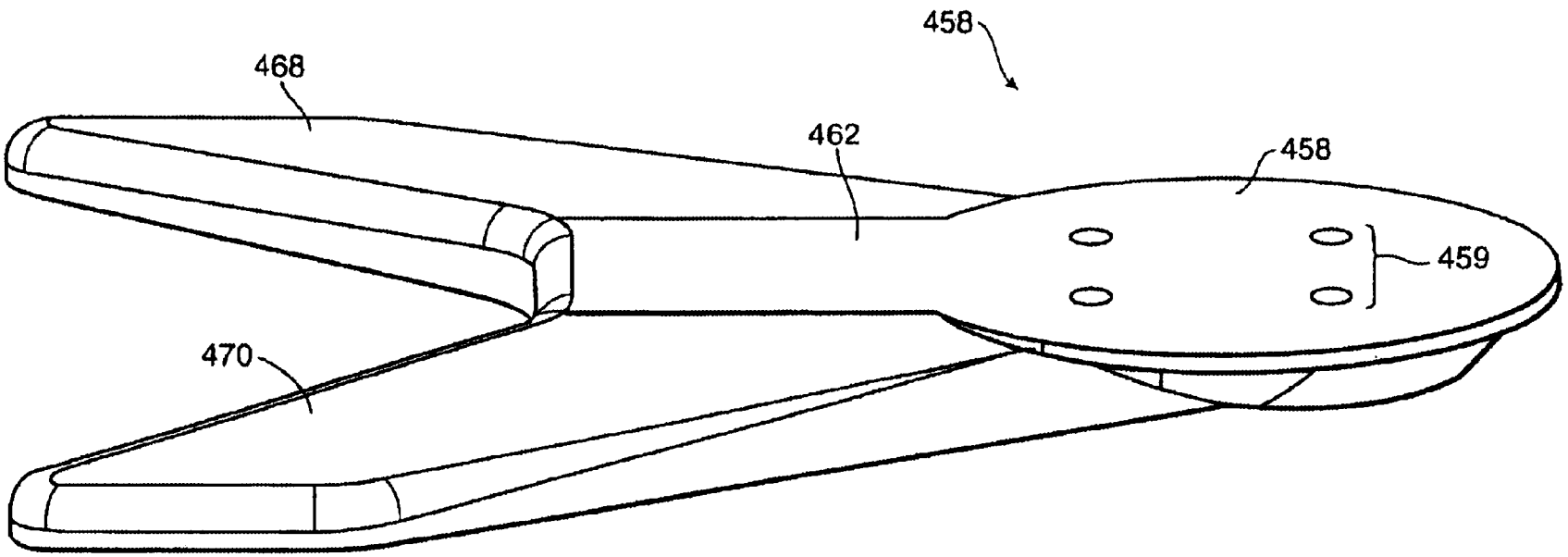
FIG. 23 is an isometric view of a V-drive member of the V-drive snowboard in FIG. 20.

To turn, the snowboard 450 is turned on its running edge 426 as the snowboarder leans to drive the running edge 426 into the slope. By leaning, the snowboarder causes a torque to be applied at torsional bases 456 and 458 of the V-drives 452 and 454 to the body 412 of the snowboard 450 about the snowboard's 450 longitudinal axis $A_2$. The V-drives 452 and 454 advantageously apply a load through the stiffener fingers 466 and 470 of the V-plates 460 and 462 along the running edge 426 of the body 412 at load points 435 and 437. If the snowboard was turned on the snowboard's opposite running edge along the opposite side edge 418 to turn the snowboard in the other direction, a similar torque would be applied at the torsional bases 456 and 458 and the V-drives 452 and 454 would advantageously apply a load through the stiffener fingers 464 and 468 along the opposite running edge at load points similarly located adjacent the ends of the fingers 464 and 468. As compared to the conventional snowboard 10 (FIG. 1), the V-drives 452 and 454 advantageously direct the load applied by the snowboard during a turn to load points 435 and 437 that are much closer to the central axis $A_1$ than the load points 34 and 36 of the conventional snowboard 10 (see FIGS. 2 and 4–5). Because the snowboarder's boots 423 and 425 are elevated and the load points 435 and 437 are applied closer to the central axis $A_1$, the body 412 of the V-drive snowboard 450 flexes an additional amount as shown by the cross-hatched areas 438A and 440A in FIG. 22. The increased flex areas 438A and 440A increase the length of positive running edges 428 and 430 along the running edge 426 at edge portions 428A and 430A. The ratio of a positive running edge, which causes the snowboard to follow an arc defined path, to a negative running edge, which causes the snowboard not to follow an arc defined path, is far greater using the V-drive snowboard 450. As shown in FIG. 21, the turning shape of the running edge 426 of the V-drive snowboard 450 is a substantially smooth turn-carving arc. The turn-carving arc shape of the running edge 426 causes the V-drive snowboard 450 to follow a path defined by the arc rather than sliding throughout the turn.

As a result of its construction, the V-drive snowboard 450 is more responsive and its performance is more predictable. By elevating the snowboarder's boots 423 and 425 above the body 412, the snowboarder has greater leverage to make more aggressive turns. By directing the load toward the central axis A1 of the snowboard 450, the running edge 426 of the snowboard 450 more easily deforms into a smooth turn carving arc, which results in more precise turns, less slide, and better edge hold through the turn.

In addition, a more drastic side cut can be incorporated with the V-drive snowboard 450. Because the snowboarder's boots are elevated from the body 412, the waist or midsection of the body 412 can be made narrower without causing the snowboarder's feet to drag during a turn. A more drastic side cut will further enhance the turn-carving characteristics of the V-drive snowboard 450.

Figure 25:
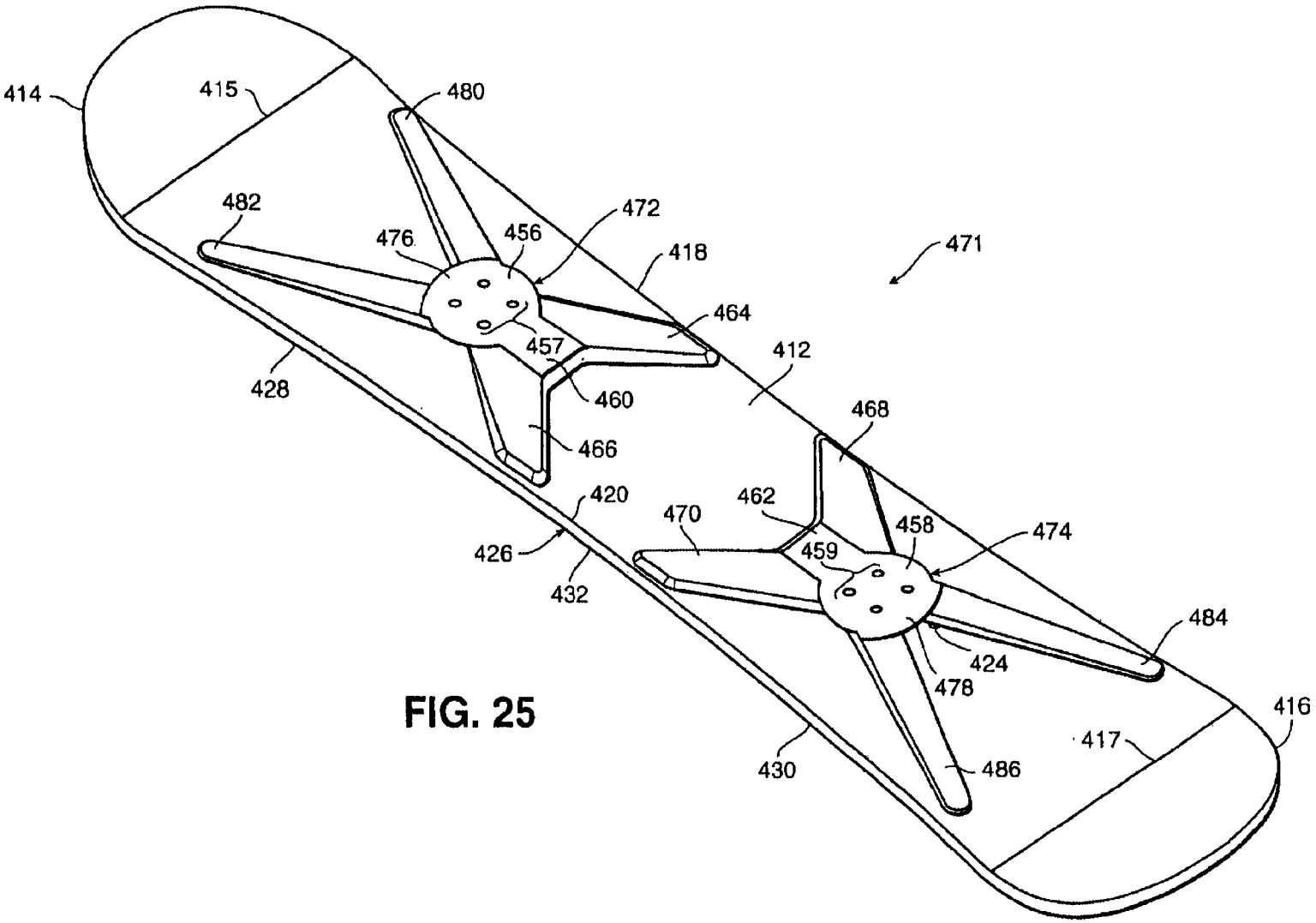
FIG. 25 is an isometric view of an X-drive snowboard of the present invention.
Figure 26:
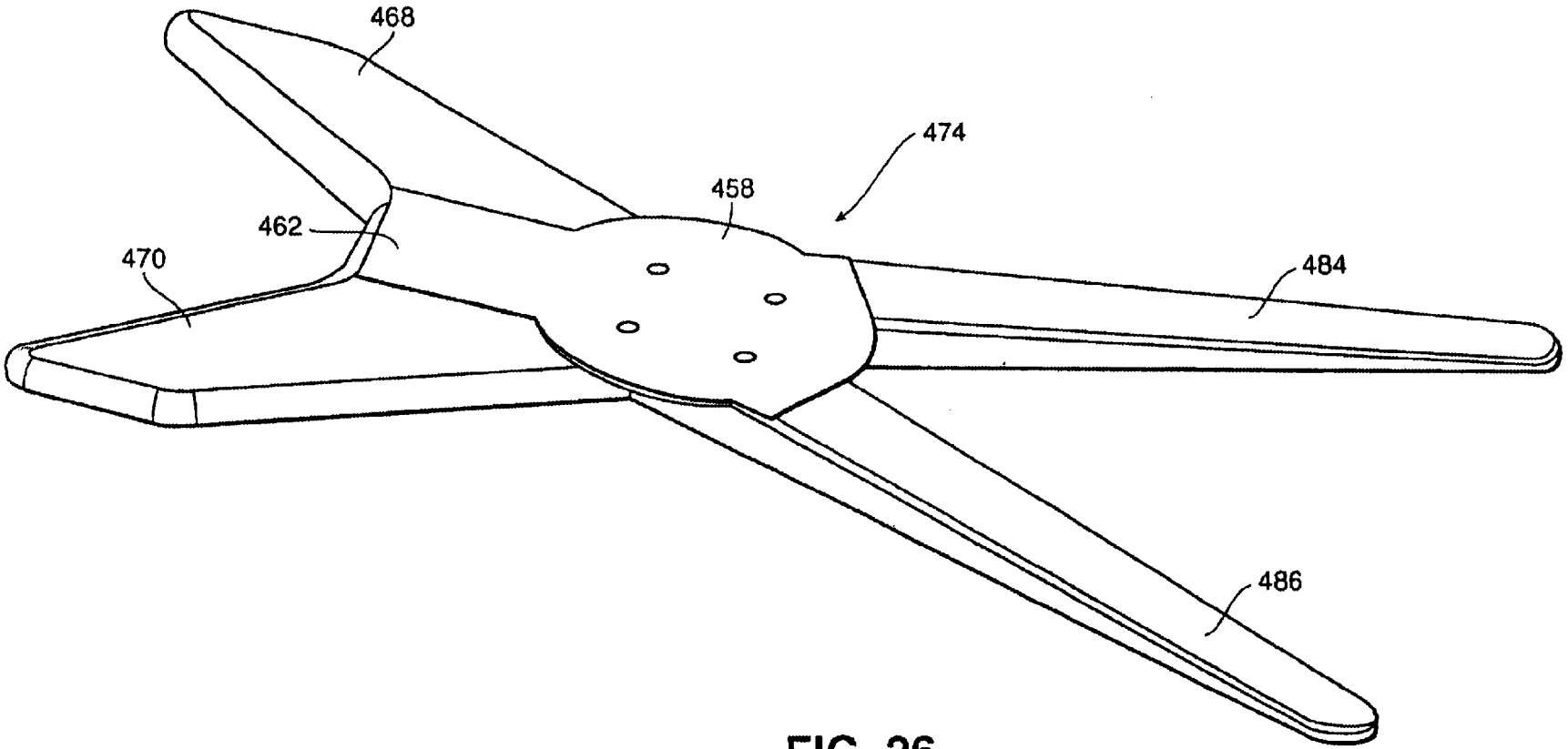
FIG. 26 is an isometric view of an X-drive member of the X-drive snowboard in FIG. 25.

Referring to FIGS. 25 and 26, an X-drive snowboard 471 incorporates the advantages and characteristics of the V-drive snowboard 450 while adding shock absorption and/or vibration dampening characteristics to the snowboard. The X-drive snowboard 471 comprises opposing X-drives 472 and 474 which include the torsional bases 456 and 458 and V-plates 460 and 462 of the V-drives shown in FIGS. 20 and 22–24. The X-drives 472 and 474 also include X-plates 476 and 478 having stiffening fingers 480 and 482, 484, and 486 that radially extend outwardly from the torsional bases 456 and 458 toward the sides 418 and 420 of the body 412 adjacent the ends 414 and 416 of the nose and tail of the X-drive snowboard 471.

In operation, the stiffener fingers 480 and 482, 484, and 486 of the X-plates 476 and 478 will act as shock absorbers and/or vibration dampeners. As the board bends or twists as it flexes during turning or other operations, shearing occurs between the body 412 and the fingers 480 and 482, 484 and 486. The buildup of friction between the X-plates 476 and 478 and the body 412 of the snowboard 471 advantageously causes a dampening of the vibration of the snowboard 471. Thus, the running edge 426 of the X-drive snowboard 471 can be driven into the snow with more force than with the V-drive snowboard 450. In addition, the X-plates 476 and 478 advantageously tend to reduce the concentration of stress along the running edge 426 at the load points 435 and 437 adjacent the end of the stiffener fingers 466 and 470 of the V-drives 452 and 454.

The V-drive and X-drive snowboards 450 and 471 shown in FIGS. 20–26 include V- and X-drives 452, 454, 472 and 474 that are mountable to conventional snowboards.

Figure 27:
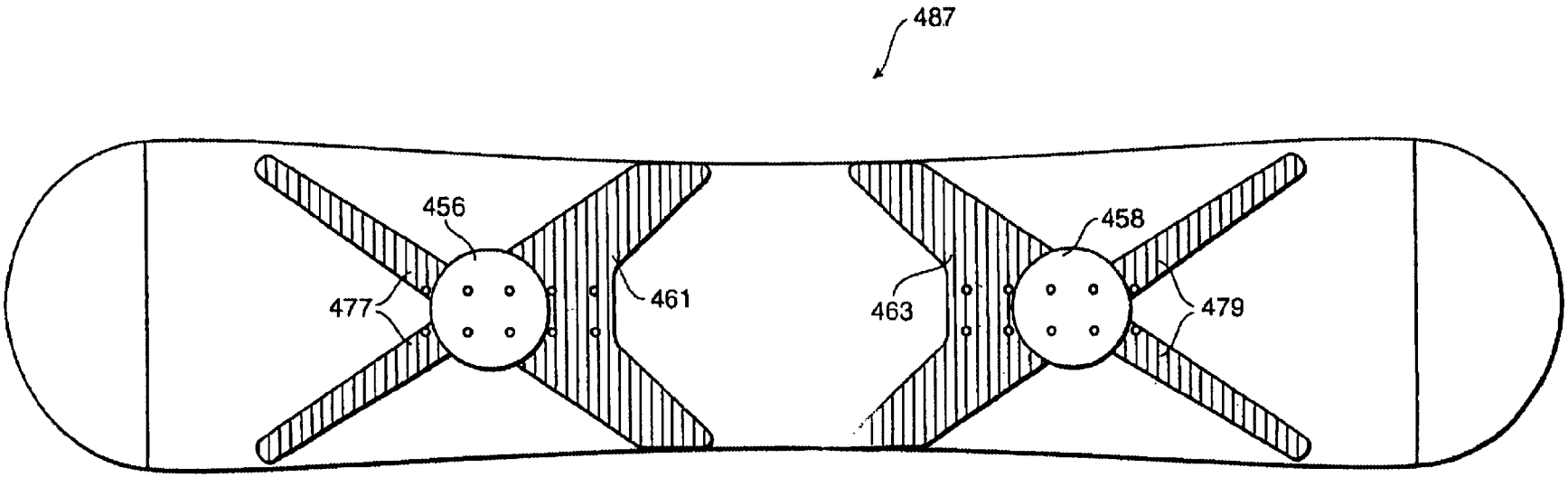
FIG. 27 is a top view of an integrated X-drive snowboard.

Referring to FIG. 27, the same advantages and characteristics of these V- and X-drives 452, 454, 472, and 474 could be provided in an integrated snowboard 487 by increasing the stiffness of the cross-hatched areas 461, 463, 477, and 479. By increasing the stiffness in the cross-hatched areas 461, 463, 477, and 479, the flex areas and positive running edges of the snowboard 487 are thereby increased. The stiffness of the cross-hatched areas 461, 463, 477 and 479 of the snowboard 487 can be increased by utilizing a special layup or internal stiffeners. Thus, the combination of these areas of increased stiffness with the elevation of the snowboarder's boot on torsional base mounts 456 and 458 will provide the same or similar benefits experienced with the externally mounted V- and X-drive snowboards 450 and 471.

Figure 28:
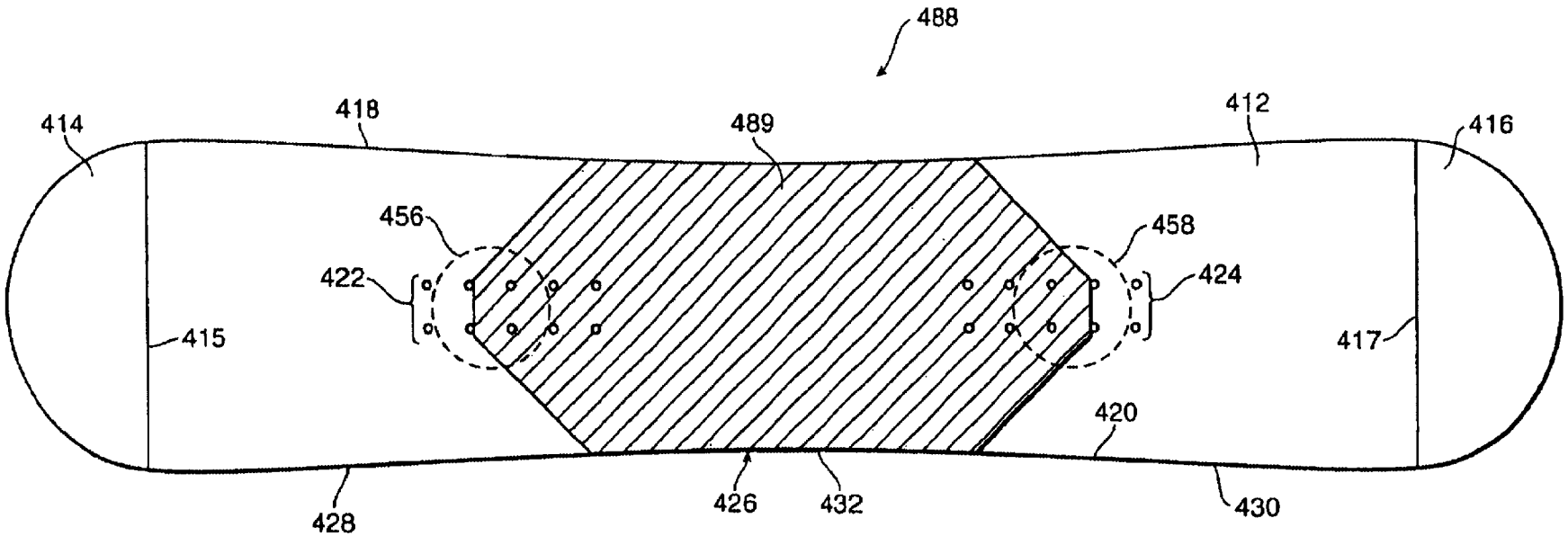
FIG. 28 is a top view of an integrated diamond-drive snowboard.

Turning to FIG. 28, a diamond drive snowboard 488 comprises a diamond drive stiffener 489 embedded in the body 412 of the snowboard 488. As with the V-drive snowboard 450, the diamond drive 489 will direct the turning torque applied at the elevated torsional bases 456 and 458 (shown in phantom) toward the central axis of the snowboard 488. Thus, the diamond drive snowboard 488 will have an increased flex area that will result in a larger positive running edge 428 and 430, which will provide better turning characteristics.

Figure 29:
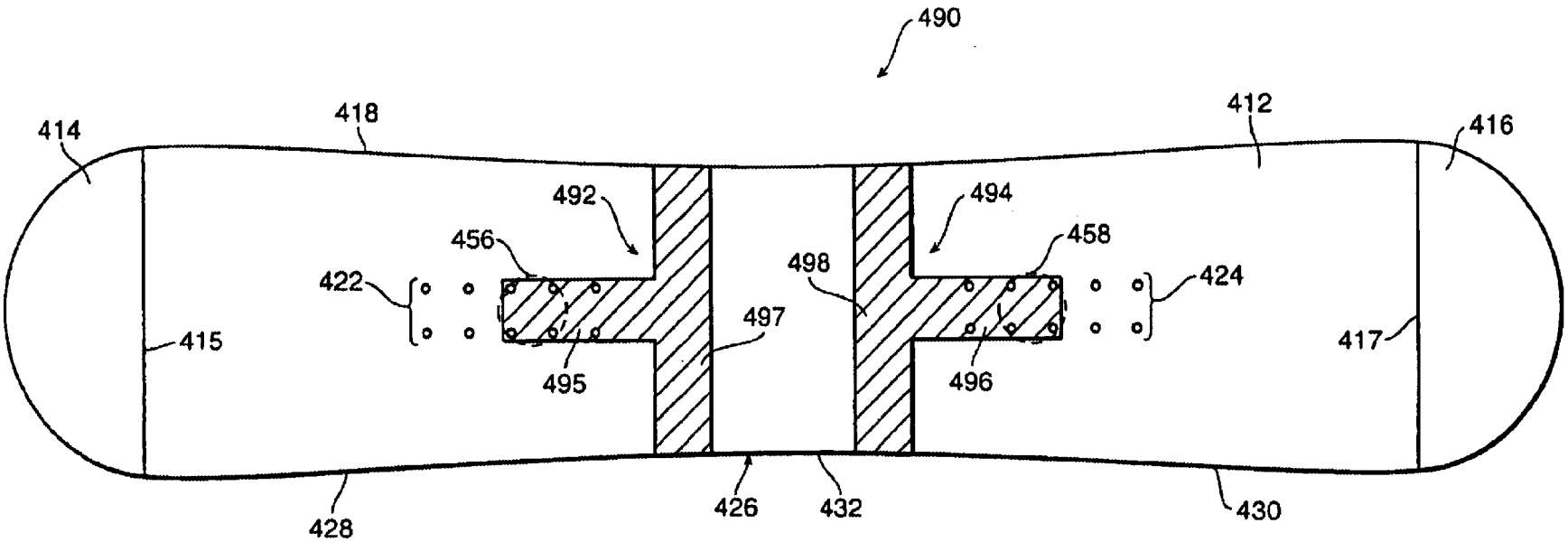
FIG. 29 is a top view of an integrated T-drive snowboard.

Similarly, a T-drive snowboard 490, shown in FIG. 29, will also provide an increased flex area in the body 412 of the T-drive snowboard 490 that will result in a larger positive running edge 428 and 430. The T-drive snowboard 490 comprises T-drives 492 and 494 integrated into the body 412. The T-drives 492 and 494 include stem stiffeners 495 and 496 extending toward the central axis of the snowboard 490 from elevated torsional bases 456 and 458 (shown in phantom) and cross-bar stiffeners 497 and 498 extending outwardly to the sides 418 and 420 of the body 412 of the T-drive snowboard 490 adjacent the central axis.

While the above description contains many specificities, these should not be construed as limitations on the scope of the invention, but rather as an exemplification of the preferred embodiments thereof. Other variations are possible.

Accordingly, the scope of the present invention should be determined not by the embodiments illustrated above, but by the appended claims and their legal equivalents.

What is claimed is:

1. A board for traversing a snow covered slope, comprising an elongated body, and a plurality of load distributing members coupled to said body and comprising a base and a plurality of stiffeners distributing a load applied by a rider to the body along an edge of the body beyond the outer boundaries of the base and therebetween, said plurality of stiffeners creating at least one bend axis in the body spaced apart from an outer boundary of the base, wherein said plurality of stiffeners distribute the load along a portion of the edge of the body that is greater than the width of the base, and a plurality of mounting pins extending vertically from the body and passing through holes in the base, wherein said base is pivotally mountable to said body and pivotable about an axis extending between the plurality of mounting pins and parallel to a longitudinal axis of the board.

2. The board of claim 1 further comprising washers fixed to upper ends of the mounting pins for retaining the base on the mounting pins.

3. The board of claim 1 wherein the base is entirely within the outer boundaries of the body.

4. The board of claim 1 wherein the plurality of stiffeners further comprise elongated members extending outwardly from the base in a direction along the edge of the body.

* * * * *